US009910401B2

(12) United States Patent
Nagae et al.

(10) Patent No.: US 9,910,401 B2
(45) Date of Patent: Mar. 6, 2018

(54) CARTRIDGE AND MEMBER USED FOR CARTRIDGE

(71) Applicant: CANON KABUSHIKI KAISHA, Tokyo (JP)

(72) Inventors: Hideki Nagae, Yokohama (JP); Masaaki Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/263,887

(22) Filed: Sep. 13, 2016

(65) Prior Publication Data

US 2017/0075292 A1 Mar. 16, 2017

(30) Foreign Application Priority Data

Sep. 16, 2015 (JP) ..... 2015-183148

(51) Int. Cl.
*G03G 15/00* (2006.01)
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1821* (2013.01); *G03G 21/1853* (2013.01)

(58) Field of Classification Search
CPC ..... G03G 21/1647; G03G 21/1676; G03G 21/1821; G03G 21/1853
See application file for complete search history.

(56) References Cited

U.S. PATENT DOCUMENTS 6,735,406 B1 5/2004 Noda
8,050,593 B2 * 11/2011 Furuichi ..... G03G 21/1853 399/110
2007/0071496 A1 3/2007 Lee
2008/0159772 A1 7/2008 Koishi
2008/0159775 A1 7/2008 Koishi et al.
2014/0205321 A1 7/2014 Jang

FOREIGN PATENT DOCUMENTS

EP 0679966 A2 11/1995
EP 0757303 A2 2/1997
EP 0757304 A2 2/1997
JP 2003-330335 A 11/2003

* cited by examiner

*Primary Examiner* — David M Gray
*Assistant Examiner* — Michael Harrison
(74) *Attorney, Agent, or Firm* — Canon U.S.A., Inc. IP Division

(57) ABSTRACT

A development container includes a positioning portion and a rotation stop portion engaged with and guided by a guide of an image forming apparatus, and a longitudinal positioning portion, at one end in an axial direction of a developer carrying member. In a state where a cartridge is attached to the image forming apparatus, when a cross-sectional positioning range is defined by using a width, having one end at a point at which the rotation stop portion contacts the guide and another end at a point at which the positioning portion contacts the guide in an attachment direction of the cartridge, and a height being a width of the guide at the point at which the rotation stop portion contacts the guide or the point at which the positioning portion contacts the guide, the longitudinal positioning portion overlaps the cross-sectional positioning range in a longitudinal direction.

6 Claims, 19 Drawing Sheets

CARTRIDGE AND MEMBER USED FOR CARTRIDGE

BACKGROUND OF THE INVENTION

Field of the Invention

The present invention relates to an electrophotographic image forming apparatus (hereinafter, image forming apparatus), a cartridge attachable to and detachable from an apparatus main body of the image forming apparatus, and a member used for the cartridge.

In this case, the image forming apparatus forms an image on a recording medium by using an electrophotographic image forming process. Examples of the image forming apparatus include, for example, an electrophotographic copier, an electrophotographic printer (for example, laser beam printer, LED printer, etc.), a facsimile device, and a word processor.

Also, the cartridge may be a configuration including an electrophotographic photosensitive drum (hereinafter, photosensitive drum) being an image carrying member, or a process unit acting on the photosensitive drum (for example, developer carrying member (hereinafter, developing roller)) in a cartridge form, and is attachable to and detachable from the image forming apparatus. The cartridge may be a configuration in a cartridge form including the photosensitive drum and the developing roller in an integrated manner or a configuration in a multiple-cartridge form including the photosensitive drum and the developing roller in a separate manner. The former configuration including the photosensitive drum and the developing roller is called process cartridge. The latter configuration including the photosensitive drum is called drum cartridge. The latter configuration including the developing roller is called development cartridge.

Description of the Related Art

Conventionally, in an image forming apparatus, a process cartridge system is employed, in which a process unit is integrally formed in a cartridge form and this cartridge is attachable to and detachable from an apparatus main body of the image forming apparatus.

With this process cartridge system, since maintenance of the image forming apparatus can be executed by a user without a service person, usability is markedly increased. Hence, this process cartridge system is widely used in the image forming apparatus.

Conventionally, for the process cartridge system, as a configuration that positions the cartridge with respect to an apparatus main body of the image forming apparatus in the longitudinal direction, there is known a configuration provided with a portion that is fitted to the apparatus main body at an end portion in the longitudinal direction (U.S. Pat. No. 8,050,593 and Japanese Patent Laid-Open No. 2003-330335).

SUMMARY OF THE INVENTION

The present invention provides a cartridge attachable to and detachable from an image forming apparatus, including a rotatable developer carrying member; and a development container configured to support the developer carrying member. The development container includes a positioning portion and a rotation stop portion provided at one end in an axial direction of the developer carrying member and configured to be engaged with and guided by a guide of the image forming apparatus, and also includes a longitudinal positioning portion provided at the one end in the axial direction of the developer carrying member and configured to contact the guide and position the development container in a longitudinal direction. In a state where the cartridge is attached to the image forming apparatus, when a cross-sectional positioning range is defined by using a width, having one end at a point at which the rotation stop portion contacts the guide and another end at a point at which the positioning portion contacts the guide in an attachment direction of the cartridge, and a height being a width of the guide at the point at which the rotation stop portion contacts the guide or the point at which the positioning portion contacts the guide, the longitudinal positioning portion overlaps the cross-sectional positioning range in the longitudinal direction.

The present invention also provides a member used for a cartridge attachable to and detachable from an image forming apparatus. The cartridge includes a rotatable developer carrying member, and a development container configured to support the developer carrying member. The member includes a positioning portion and a rotation stop portion provided at one end of the development container in an axial direction of the developer carrying member and configured to be engaged with and guided by a guide of the image forming apparatus, and also includes a longitudinal positioning portion provided at the one end in the axial direction of the developer carrying member and configured to contact the guide and position the member in a longitudinal direction. In a state where the cartridge is attached to the image forming apparatus, when a cross-sectional positioning range is defined by using a width, having one end at a point at which the rotation stop portion contacts the guide and another end at a point at which the positioning portion contacts the guide in an attachment direction of the cartridge, and a height being a width of the guide at the point at which the rotation stop portion contacts the guide or the point at which the positioning portion contacts the guide, the longitudinal positioning portion overlaps the cross-sectional positioning range in the longitudinal direction.

Further features of the present invention will become apparent from the following description of exemplary embodiments with reference to the attached drawings.

DESCRIPTION OF THE EMBODIMENTS

A cartridge and an image forming apparatus according to an embodiment of the present invention are described with reference to the drawings. In this embodiment, the above-described development cartridge that is attachable to and detachable from the image forming apparatus is exemplarily described. In this specification, the apparatus main body of the image forming apparatus is a residual portion of the image forming apparatus except the cartridge. Also, in the following description, the longitudinal direction is a direction substantially parallel to a rotational axis L1 of a rotatable photosensitive drum (image carrying member) and a rotational axis L9 of a rotatable developing roller (developer carrying member), that is, an axial direction of each of the photosensitive drum and the developing roller. Also, the transverse direction is a direction substantially orthogonal to the rotational axis L1 of the photosensitive drum and the rotational axis L9 of the developing roller. In this embodiment, the direction in which the drum cartridge and the development cartridge are detached from and attached to a laser beam printer main body is the transverse direction of each cartridge. The conveying direction of a recording medium is a direction intersecting with the rotational axis L1 of the photosensitive drum and the rotational axis L9 of the developing roller, that is, the transverse direction. In this case, reference signs in the following description are provided for referencing the drawings, and do not intend to limit the configuration.

(1) General Description on Image Forming Apparatus

Figure 2:
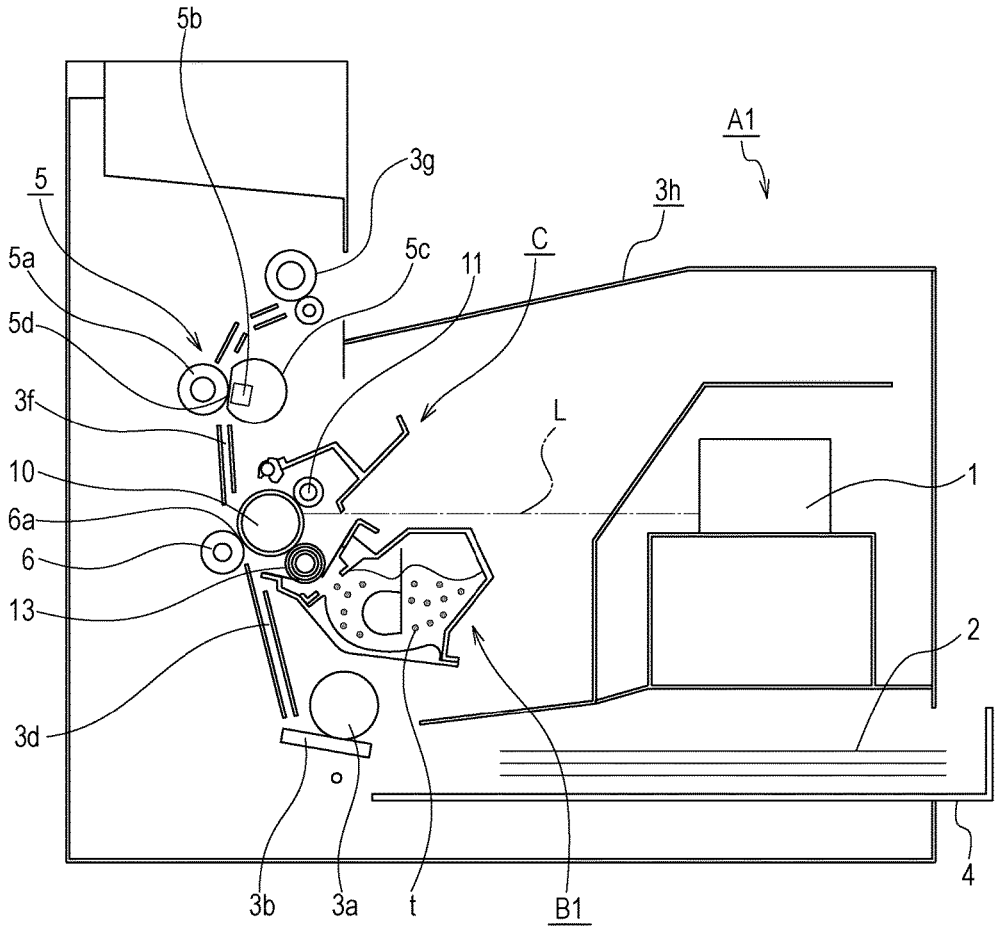
FIG. 2 is a cross-sectional explanatory side view of an electrophotographic image forming apparatus according to the embodiment.

First, a general configuration of the image forming apparatus is described with reference to FIG. 2. FIG. 2 is a cross-sectional explanatory side view of the image forming apparatus.

The image forming apparatus shown in FIG. 2 forms an image with a developer t on a recording medium 2 by an electrophotographic image forming process in accordance with image information output from an external device such as a personal computer. Also, in the image forming apparatus, a development cartridge B1 and a drum cartridge C are provided in a manner attachable to and detachable from an apparatus main body A1 by a user. Examples of the recording medium 2 may be a recording sheet of paper, a label sheet of paper, an OHP sheet, a piece of cloth, and other material. The apparatus main body A1 includes an optical unit 1, a transfer unit, a fixing unit 5, and a feed unit of the recording medium 2. Also, the development cartridge B1 includes a developing unit such as a developing roller 13, and the drum cartridge C includes a photosensitive drum 10 and a charging roller 11.

The photosensitive drum 10 uniformly electrically charges the surface of the photosensitive drum 10 with use of the charging roller 11 by application of a voltage from the apparatus main body A1. Then, the optical unit 1 irradiates the charged photosensitive drum 10 with a laser beam L corresponding to image information, and forms an electrostatic latent image corresponding to the image information on the photosensitive drum 10. This electrostatic latent image is developed by the developing unit (described later) with the toner t, and hence a developer image is formed on the surface of the photosensitive drum 10.

Recording media 2 housed in a sheet feed tray 4 are regulated by a sheet feed roller 3*a* and a separating pad 3*b* in pressure contact with the sheet feed roller 3*a*, and separately fed one by one in synchronization with the formation of the developer image. Then, the separated recording medium 2 is conveyed to a transfer roller 6 serving as a transfer unit by a conveyance guide 3*d*. The transfer roller 6 is urged to contact the surface of the photosensitive drum 10. Hence, the photosensitive drum 10 and the transfer roller 6 form a transfer nip 6*a*. The recording medium 2 passes through the transfer nip 6*a*. At this time, a voltage with a reverse polarity reverse to the developer image is applied to the transfer roller 6. Accordingly, the developer image formed on the surface of the photosensitive drum 10 is transferred to the recording medium 2.

The recording medium 2 having the developer image transferred thereon is regulated by a conveyance guide 3*f* and conveyed to the fixing unit 5. The fixing unit 5 includes a driving roller 5*a* and a fixing roller 5*c* having a heater 5*b* arranged therein. When the recording medium 2 passes through a nip 5*d* formed by the driving roller 5*a* and the fixing roller 5*c*, heat and pressure are applied to the recording medium 2 and the developer image transferred on the recording medium 2 is fixed to the recording medium 2. Accordingly, the image is formed on the recording medium 2. Then, the recording medium 2 is conveyed by a discharge roller pair 3*g*, and output to a discharge portion 3*h*.

Figure 3:
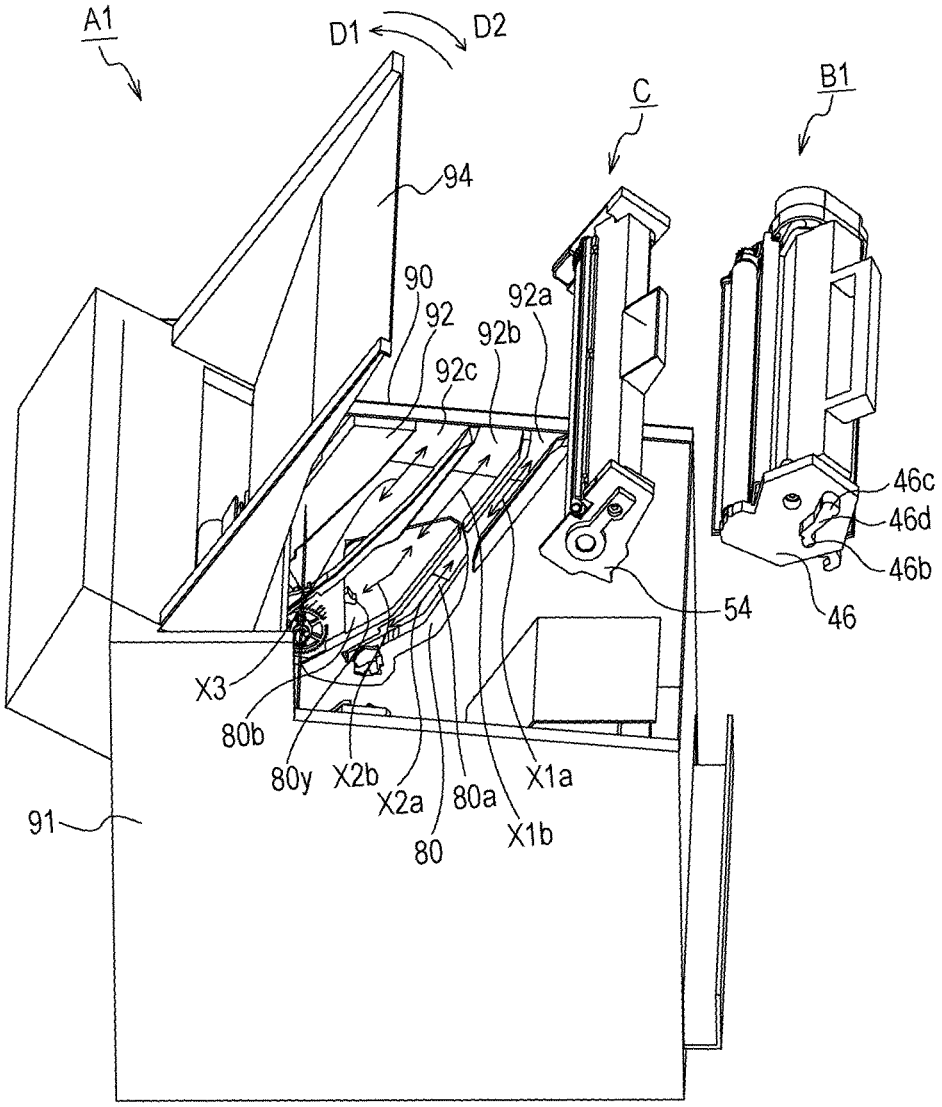
FIG. 3 is a perspective explanatory view of an apparatus main body according to the embodiment when viewed from a nondrive side.

At a drive side of the apparatus main body A1, as shown in FIG. 3, a drive-side guide member 92 is provided at a drive-side side plate 90 that configures a housing of the apparatus main body A1, and also, a drive-side swing guide 80 that moves together with the development cartridge B1 in the apparatus main body A1 is provided. The drive-side guide member 92 has a first guide portion 92*a*, a second guide portion 92*b*, and a third guide portion 92*c*. The drive-side swing guide 80 has a first guide portion 80*a* and a second guide portion 80*b*. The drive-side guide member 92 has an attachment/detachment path X1*a* configured by the first guide portion 92*a* having a groove shape, and an attachment/detachment path X1*b* configured by the second guide portion 92*b* being a groove shape. The drive-side guide member 92 further has an attachment/detachment path X3 configured by the third guide portion 92*c* having a groove shape. Hence, the drum cartridge C can be attached and detached. The first guide portion 80*a* of the drive-side swing guide 80 has a groove shape connected to the attachment/detachment path X1*a* of the first guide portion 92*a* of the drive-side guide member 92, and configures an attachment/detachment path X2*a* for the development cartridge B1. The second guide portion 80*b* of the drive-side swing guide 80 has a groove shape connected to the attachment/detachment path X1*b* of the second guide portion 92*b* of the drive-side guide member 92, and configures an attachment/detachment path X2*b* for the development cartridge B1. Hence, the development cartridge B1 can be attached and detached.

Figure 4:
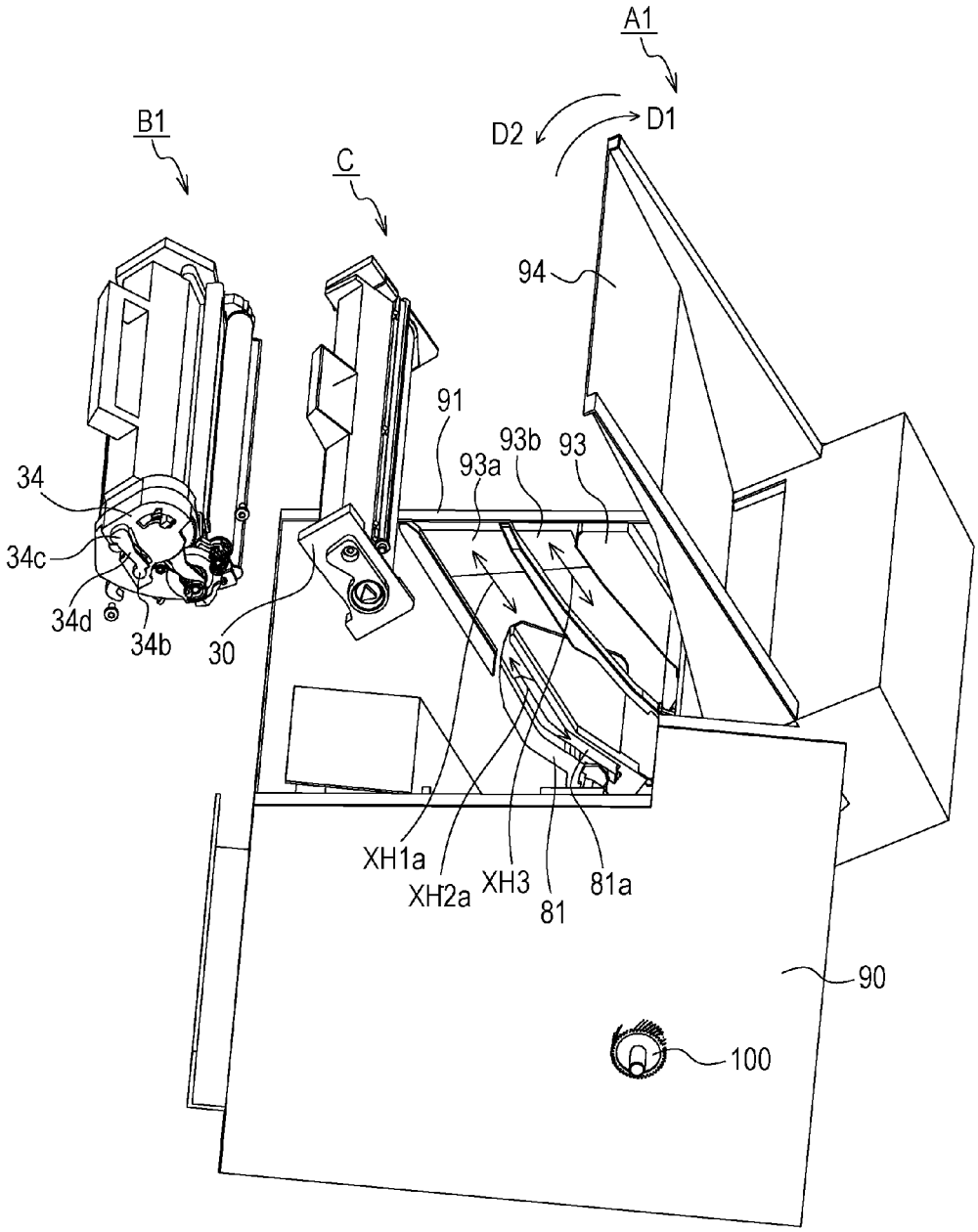
FIG. 4 is a perspective explanatory view of the apparatus main body according to the embodiment when viewed from a drive side.

Similarly, at a nondrive side of the apparatus main body A1, as shown in FIG. 4, a nondrive-side guide member 93 is provided at a nondrive-side side plate 91 that configures the housing of the apparatus main body A1, and also, a nondrive-side swing guide 81 movable similarly to the drive-side swing guide 80 is provided. The nondrive-side guide member 93 has a first guide portion 93*a* and a second guide portion 93*b*. The nondrive-side swing guide 81 has a guide portion 81*a*. The nondrive-side guide member 93 has an attachment/detachment path XH1*a* configured by the first guide portion 93*a* having a groove shape. The nondrive-side guide member 93 further has an attachment/detachment path XH3 configured by the second guide portion 93*b* having a groove shape. Hence, the drum cartridge C can be attached and detached. The guide portion 81*a* of the nondrive-side swing guide 81 has a groove shape connected to the attachment/detachment path XH1*a* of the first guide portion 93*a* of the nondrive-side guide member 93, and configures an attachment/detachment path XH2*a* for the development cartridge B1.

(2) Description on Electrophotographic Image Forming Process

Figure 5:
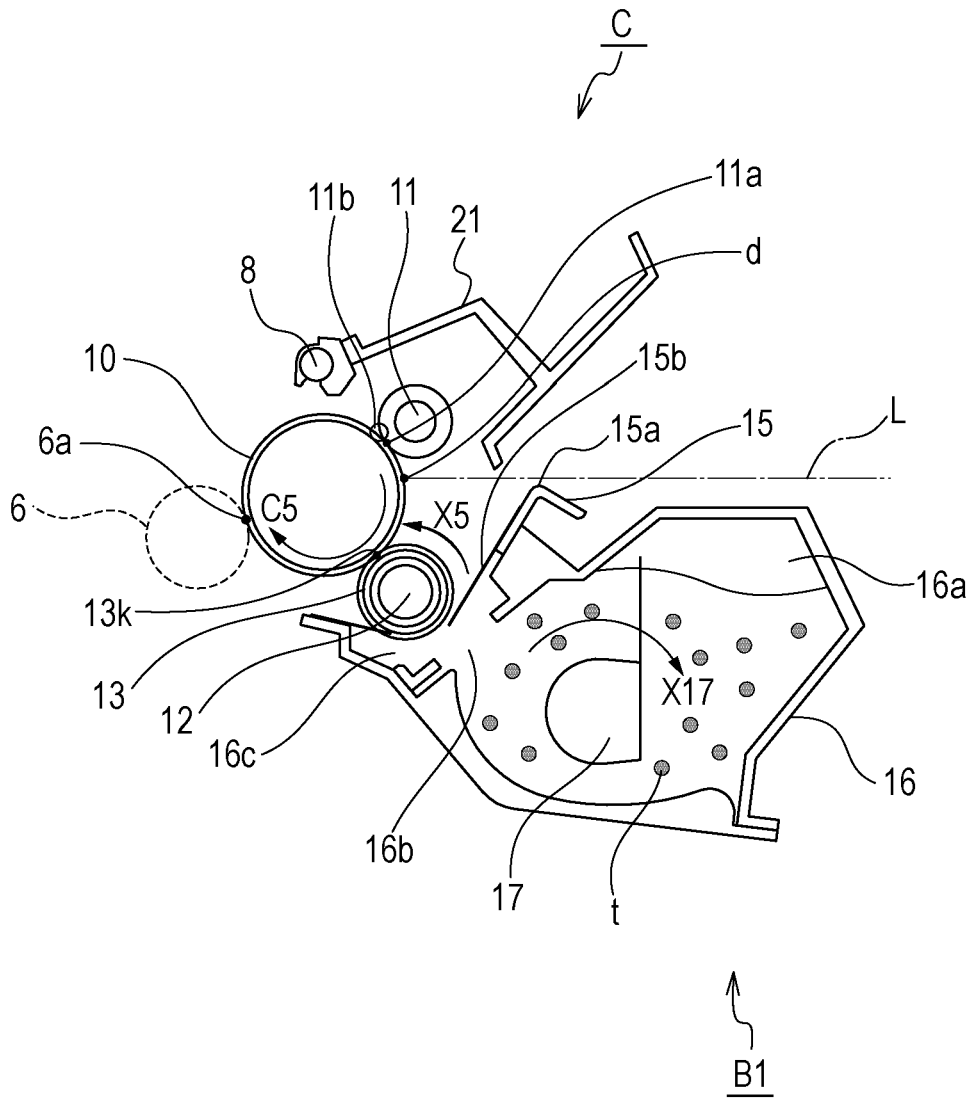
FIG. 5 is a cross-sectional explanatory view of the development cartridge and a drum cartridge according to the embodiment.

An electrophotographic image forming process is described next with reference to FIG. 5. FIG. 5 is a cross-sectional explanatory view of the development cartridge B1 and the drum cartridge C.

As shown in FIG. 5, the development cartridge B1 includes the developing roller 13 serving as a developing unit, and a development blade 15 at a development container 16. The drum cartridge C includes the photosensitive drum 10 and the charging roller 11 at a cleaning frame member 21.

A developer t stored in a developer storage portion 16*a* of the development container 16 is sent into a development chamber 16*c* through an opening 16*b* of the development container 16 when a developer conveying member 17, which is rotatably supported by the development container 16, rotates in an arrow X17 direction. The development container 16 is provided with the developing roller 13 having a magnet roller 12 arranged therein. To be specific, the developing roller 13 includes a shaft portion 13*e* and a rubber portion 13*d*. The shaft portion 13*e* is a long conductive cylindrical shape with a small diameter made of, for example, aluminum. A center portion of the shaft portion 13*e* in the longitudinal direction is covered with the rubber portion 13*d* (see FIG. 6). The rubber portion 13*d* covers the shaft portion 13*e* so that the outside shape of the rubber portion 13*d* is coaxial with the shaft portion 13*e*. The developing roller 13 attracts the developer t in the development chamber 16*c* to the surface of the developing roller 13 by the magnetic force of the magnet roller 12. The development blade 15 includes a support member 15*a* made of a metal sheet, and an elastic member 15*b* made of urethane rubber or a SUS sheet. The development blade 15 is provided so that the elastic member 15*b* elastically contacts the developing roller 13 with a constant contact pressure. When the developing roller 13 rotates in a rotational direction X5, the development blade 15 regulates the amount of the toner t adhering to the surface of the developing roller 13, and applies a triboelectric charge to the developer t. Hence, a developer layer is formed on the surface of the developing roller 13. Then, the developing roller 13 applied with a voltage from the apparatus main body A1 is rotated in the rotational direction X5 while being in contact with the photosensitive drum 10, so that the developer t is supplied to a development region of the photosensitive drum 10.

In the case of the contact development method like this embodiment, if the state where the developing roller 13 is in contact with the photosensitive drum 10 as shown in FIG. 5 is continuously kept, the rubber portion 13*d* of the developing roller 13 may be deformed. Hence, when development is not executed, the developing roller 13 can be separated from the photosensitive drum 10.

The charging roller 11, which is rotatably supported by the cleaning frame member 21 and is urged toward the photosensitive drum 10, is provided on the outer peripheral surface of the photosensitive drum 10 in a contact manner. The charging roller 11 uniformly electrically charges the surface of the photosensitive drum 10 by application of a voltage from the apparatus main body A1. The voltage to be applied to the charging roller 11 is set at a value so that the potential difference between the surface of the photosensitive drum 10 and the charging roller 11 is a discharge start voltage or higher. To be specific, a direct-current voltage of −1300 V is applied as a charging bias. At this time, the surface of the photosensitive drum 10 is uniformly electrically charged in a contact manner to −700 V of a charging potential (dark-area potential). Also, in this embodiment, the charging roller 11 is rotationally driven by the rotation of the photosensitive drum 10. Then, an electrostatic latent image is formed on the surface of the photosensitive drum 10 by the laser beam L of the optical unit 1. Then, the developer t is transferred in accordance with the electrostatic latent image of the photosensitive drum 10, the electrostatic latent image is visualized, and hence a developer image is formed on the photosensitive drum 10.

(3) Description on Configuration of Cleanerless System

A cleanerless system used in this embodiment is described next.

In this embodiment, there is not provided a cleaning member that removes a transfer residual developer, which has not been transferred and has remained on the photosensitive drum 10, from the surface of the photosensitive drum 10. That is, the cleanerless system is used.

As shown in FIG. 5, the photosensitive drum 10 is rotationally driven in an arrow C5 direction. After the transfer step, the transfer residual developer (not shown) may remain on the surface of the photosensitive drum 10. The transfer residual developer is electrically charged to have the negative polarity similarly to the photosensitive drum by discharge at an upstream gap portion 11*b* being a gap portion located at the upstream side of a charge nip 11*a* being a contact area between the charging roller 11 and the photosensitive drum 10 in view in the rotational direction C5 of the photosensitive drum 10. At this time, the surface of the photosensitive drum 10 is charged to −700 V. The transfer residual developer charged to have the negative polarity does not adhere to the charging roller 11 and passes therethrough because of the relationship of the potential difference at the charge nip 11*a* (photosensitive drum 10 surface potential=−700 V, charging roller 11 potential=−1300 V).

The transfer residual developer, which has passed through the charge nip 11*a*, reaches a laser irradiation position d. The amount of the transfer residual developer is not so large that blocks the laser beam L of the optical unit, and hence, the transfer residual developer does not affect a step of forming the electrostatic latent image on the photosensitive drum 10. The transfer residual developer, which has passed through the laser irradiation position d and located at a non-exposure area (a portion of the surface of the photosensitive drum 10 not exposed to laser irradiation) is collected by the developing roller 13 using a static force at a development nip 13*k* being a contact area between the developing roller 13 and the photosensitive drum 10. In contrast, the transfer residual developer in an exposure area (a portion of the surface of the photosensitive drum 10 exposed to laser irradiation) is not collected by the static force, and is continuously present on the photosensitive drum 10. However, a portion of the transfer residual developer is collected by a physical force due to the peripheral speed difference between the developing roller 13 and the photosensitive drum 10.

A major portion of the transfer residual developer not transferred on a sheet and remaining on the photosensitive drum 10 is collected in the development container 16 through the developing roller 13. The transfer residual developer collected in the development container 16 is mixed with the developer t remaining in the development container 16 and used.

In this embodiment, in order to allow the transfer residual developer to pass through the charge nip 11*a* without adhering to the charging roller 11 and to allow the transfer residual developer to be collected more in the development container 16, the following two configurations are employed. First, an optical static-reducing member 8 is provided between the transfer roller 6 and the charging roller 11. The optical static-reducing member 8 is located at the upstream side of the charge nip 11*a* in the rotational direction (arrow C5) of the photosensitive drum 10. For stable discharge at the upstream gap portion 11*b*, the static is reduced for the potential of the surface of the photosensitive drum 10 after passing through the transfer nip 6*a*. The potential of the photosensitive drum 10 before charging is reduced at about −150 V in the entire longitudinal region by the optical static-reducing member 8. Accordingly, uniform discharge can be executed during charging, and the transfer residual developer can uniformly have the negative polarity.

Second, the charging roller 11 is rotationally driven while a predetermined peripheral speed difference is provided between the charging roller 11 and the photosensitive drum 10. A major portion of the toner has the negative polarity by discharge as described above. However, the transfer residual developer, which has not had the negative polarity, still remains by a small amount, and this transfer residual developer may adhere to the charging roller 11 at the charge nip 11*a*. Since the charging roller 11 and the photosensitive drum 10 are rotationally driven with the predetermined peripheral speed difference, the aforementioned transfer residual developer can have the negative polarity by sliding between the photosensitive drum 10 and the charging roller 11. Accordingly, there is an effect of reducing adhesion of the transfer residual developer to the charging roller 11. In the configuration of this embodiment, a charging roller gear 69 (FIG. 8B) is provided at longitudinal one end of the charging roller 11. The charging roller gear 69 is engaged with a drive-side flange 24 (FIG. 8B) provided at the longitudinal one end of the photosensitive drum 10. Hence, the charging roller 11 is also rotationally driven as the photosensitive drum 10 is rotationally driven. The peripheral speed of the surface of the charging roller 11 is set at about 105% to about 120% of the peripheral speed of the surface of the photosensitive drum 10.

(4) Description on Configuration of Development Cartridge B1 General Configuration of Development Cartridge B1

Figure 6:
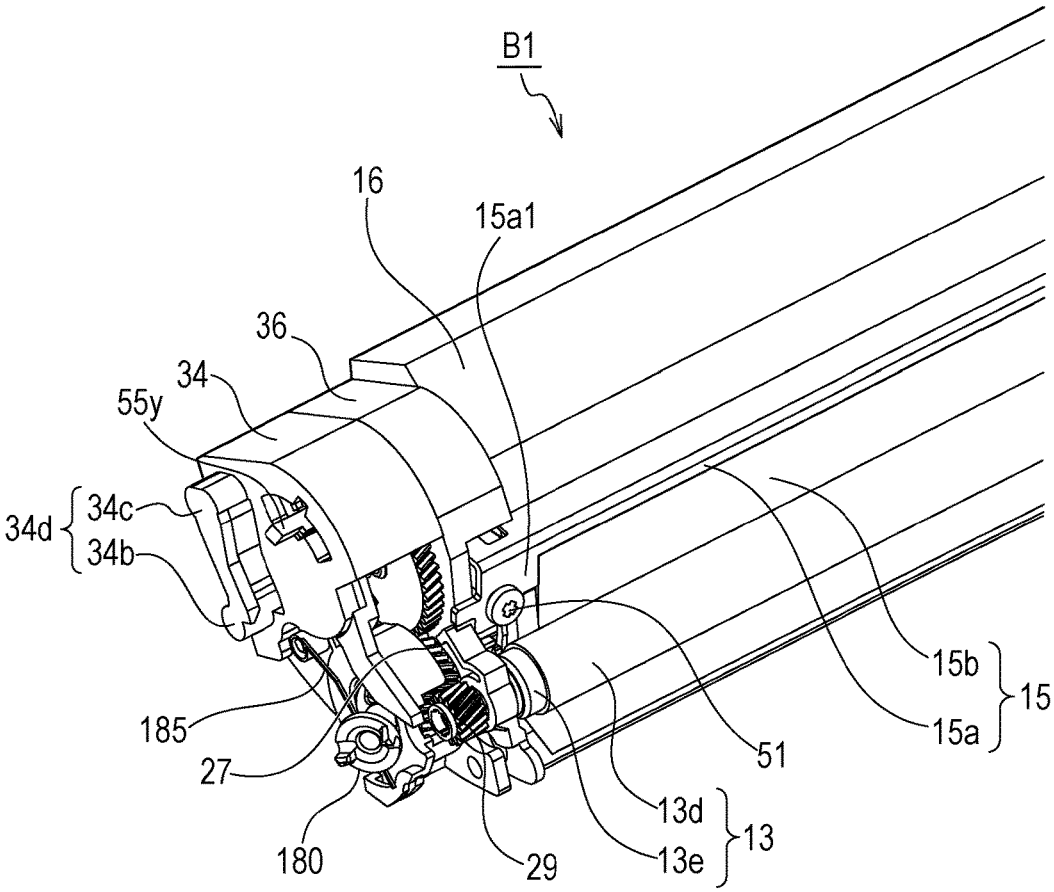
FIG. 6 is a perspective explanatory view of the development cartridge according to the embodiment when viewed from the drive side.
Figure 7:
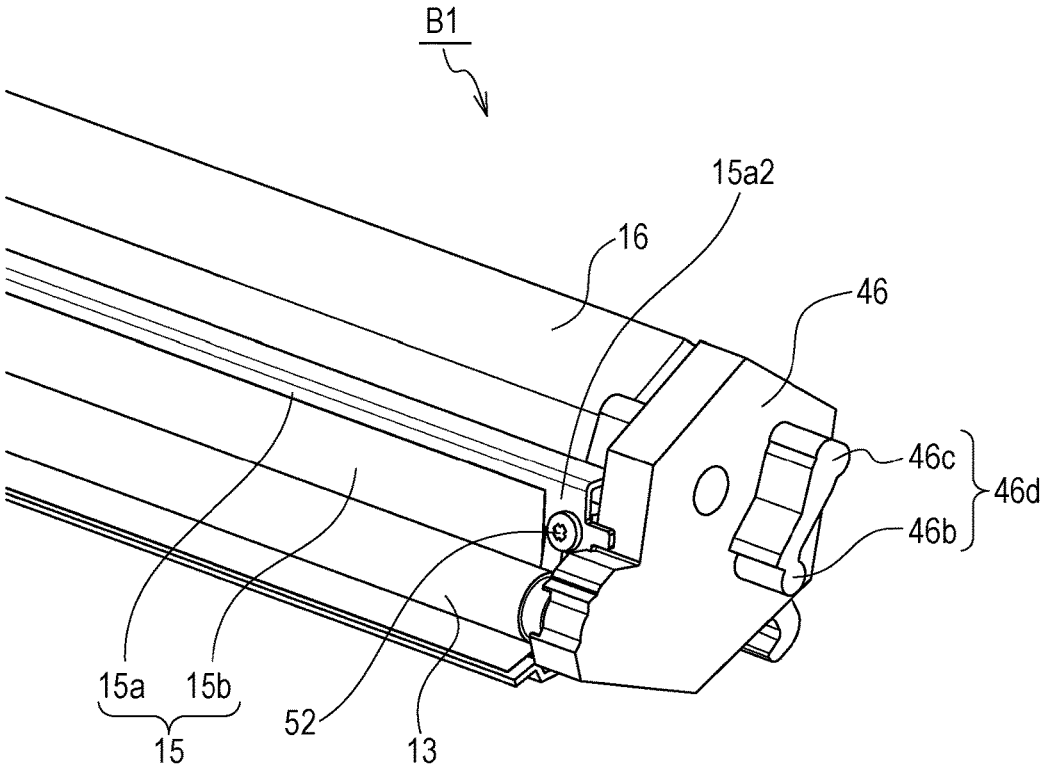
FIG. 7 is a perspective explanatory view of the development cartridge according to the embodiment when viewed from the nondrive side.

A configuration of the development cartridge B1 is described next with reference to the drawings. In the following description, it is assumed that a side at which the rotational force is transmitted from the apparatus main body A1 to the development cartridge B1 in the longitudinal direction is referred to as "drive side." A side opposite to the drive side is referred to as "nondrive side." FIG. 6 is a perspective explanatory view of the development cartridge B1 when viewed from the drive side. FIG. 7 is a perspective explanatory view of the development cartridge B1 when viewed from the nondrive side.

The development cartridge B1 includes the developing roller 13 and the development blade 15. In the development blade 15, a drive-side end portion 15*a*1 and a nondrive-side end portion 15*a*2 in the longitudinal direction of a support member 15*a* are fixed to the development container 16 by a screw 51 and a screw 52. A drive-side development bearing 36 (member) and a nondrive-side development bearing 46 are respectively provided at longitudinal both ends of the development container 16.

A drive-side end portion of the developing roller 13 is fitted to the drive-side development bearing 36, and a nondrive-side end portion of the developing roller 13 is fitted to the nondrive-side development bearing 46. Thus, the developing roller 13 is rotatably supported. Further, at the drive-side end portion of the developing roller 13, a developing roller gear 29 is arranged, coaxially with the developing roller 13, at an outer side in the longitudinal direction with respect to the drive-side development bearing 36. Thus, the developing roller 13 and the developing roller gear 29 are engaged and can be rotated together. The drive-side development bearing 36 rotatably supports a drive input gear 27 at the longitudinal outer side of the drive-side development bearing 36. The drive input gear 27 is meshed with the developing roller gear 29. Further, a coupling member 180 is provided coaxially with the drive input gear 27. Accordingly, the coupling member 180 is engaged with a main-body-side driving member 100 (FIGS. 3 and 4) provided at the apparatus main body A1. The rotational force input to the coupling member 180 is transmitted to the developing roller 13 being the rotational member through the drive input gear 27 and the developing roller gear 29.

A drive-side side cover 34 is provided at the drive-side end portion of the development cartridge B1, to cover the drive input gear 27 and other member from the longitudinal outer side. The coupling member 180 penetrates through the drive-side side cover 34 and protrudes to the longitudinal outer side.

The nondrive-side development bearing 46 includes a guided portion 46*d* having a positioning portion 46*b* and a rotation stop portion 46*c*. The drive-side side cover 34 includes a guided portion 34*d* having a positioning portion 34*b* and a rotation stop portion 34*c*. During attachment and detachment, the guided portions 46*d* and 34*d* are guided by the attachment/detachment paths X1*b* and XH1*b*, and X2*a* and XH2*b*. In this embodiment, the guided portion 34*d* has a shape in which the positioning portion 34*b* and the rotation stop portion 34*c* are integrated at a coupling portion and the coupling portion is narrowed, when viewed in the longitudinal direction. Similarly, the guided portion 46*d* has a shape in which the positioning portion 46*b* and the rotation stop portion 46*c* are integrated at a coupling portion and the coupling portion is narrowed, when viewed in the longitudinal direction.

(5) Brief Description on Drum Cartridge C

Figure 8A:
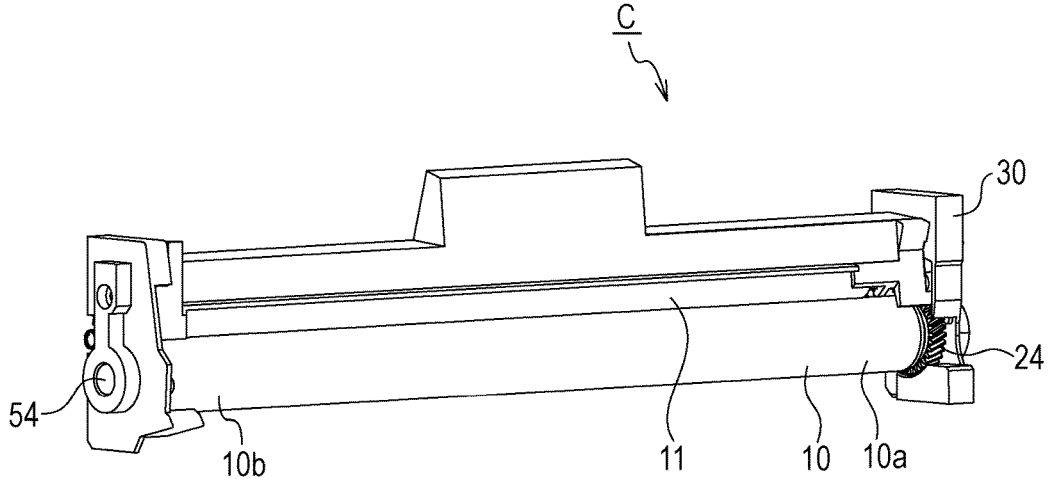
FIGS. 8A and 8B each are a perspective explanatory view of the drum cartridge according to the embodiment when viewed from the nondrive side.
Figure 8B:
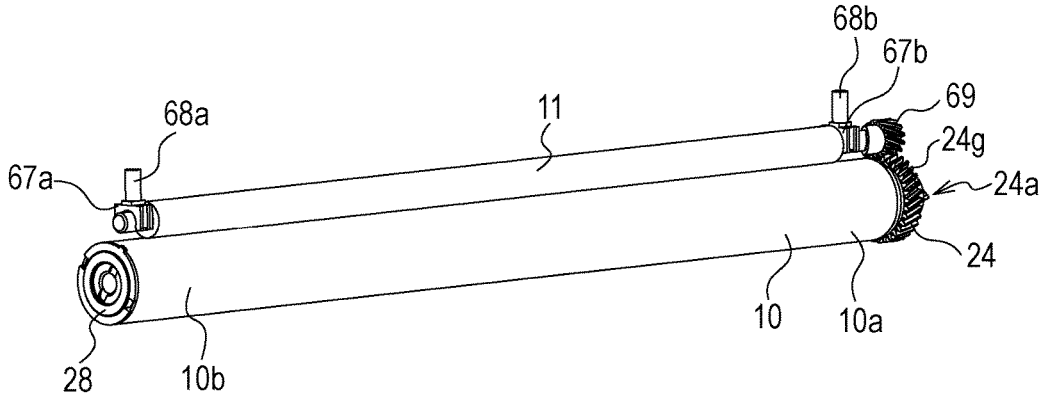

A configuration of the drum cartridge C is described next with reference to FIGS. 8A and 8B. FIG. 8A is a perspective explanatory view of the drum cartridge C when viewed from the nondrive side. FIG. 8B is a perspective explanatory view in which the cleaning frame member 21, a drum bearing 30, or a drum shaft 54 is not illustrated, for describing a peripheral portion of the photosensitive drum 10 and the charging roller 11. As shown in FIGS. 8A and 8B, the drum cartridge C includes the photosensitive drum 10 and the charging roller 11. The charging roller 11 is rotatably supported by charging roller bearings 67*a* and 67*b*, and urged with respect to the photosensitive drum 10 by charging roller urging members 68*a* and 68*b*.

The drive-side flange 24 is integrally fixed to a drive-side end portion 10*a* of the photosensitive drum 10. A nondrive-side flange 28 is integrally fixed to a nondrive-side end portion 10*b* of the photosensitive drum 10. The drive-side flange 24 and the nondrive-side flange 28 are fixed coaxially with the photosensitive drum 10 by crimping, bonding, or other method. The drum bearing 30 and the drum shaft 54 are respectively fixed to a drive-side end portion and a nondrive-side end portion of both longitudinal end portions of the cleaning frame member 21 by screwing, bonding, press-fitting, or other method. The drive-side flange 24 integrally fixed to the photosensitive drum 10 is rotatably supported by the drum bearing 30, and the nondrive-side flange 28 is rotatably supported by the drum shaft 54.

The charging roller gear 69 is provided at the longitudinal one end of the charging roller 11. The charging roller gear 69 is meshed with a gear portion 24*g* of the drive-side flange 24. A drive-side end portion 24*a* of the drive-side flange 24 is configured to receive the rotational force transmitted from the apparatus main body A1 side (not shown). Consequently, the charging roller 11 is also rotationally driven as the photosensitive drum 10 is rotationally driven.

(6) Description on Attachment/Detachment Configuration of Development Cartridge B1 to/from Apparatus Main Body A1

An attachment method of the development cartridge B1 to the apparatus main body A1 is described next with reference to the drawings. FIG. 3 is a perspective explanatory view when the apparatus main body A1 is viewed from the nondrive side. FIG. 4 is a perspective explanatory view when the apparatus main body A1 is viewed from the drive side. FIGS. 8A and 8B are explanatory views when a process of attaching the development cartridge B1 to the apparatus main body A1 is viewed from the drive side. Attachment/detachment of Development Cartridge B1 to/from Apparatus Main body A1

An attachment method of the development cartridge B1 to the apparatus main body A1 is described below. As shown in FIGS. 3 and 4, a main-body cover 94, which is arranged in an upper section of the apparatus main body A1 and is openable and closable, is rotated in an open direction D1, and hence the inside of the apparatus main body A1 is exposed.

Then, the guided portion 46*d* (FIG. 7) of the development cartridge B1 is engaged with the first guide portion 93*a* (FIG. 4) of the apparatus main body A1, and the guided portion 34*d* (FIG. 6) of the development cartridge B1 is engaged with the first guide portion 92*a* (FIG. 3) of the apparatus main body A1. Accordingly, the development cartridge B1 is inserted into the apparatus main body A1 along the attachment/detachment paths X1*a* and XH1*a* formed by the first guide portion 92*a* of the drive-side guide member 92 and the first guide portion 93*a* of the nondrive-side guide member 93.

The development cartridge B1 is inserted into the apparatus main body A1 along the attachment/detachment paths X1*a* and XH1*a*, and then is further inserted along the attachment/detachment paths X2*a* and XH2*a* formed by the first guide portion 80*a* of the drive-side swing guide 80 and the guide portion 81*a* of the nondrive-side swing guide 81. To be more specific, the guided portion 34*d* provided at the drive-side side cover 34 guided by the first guide portion 92*a* of the apparatus main body A1 is received by the first guide portion 80*a* having a bending shape of the drive-side swing guide 80 of the apparatus main body A1 by the attachment process. Similarly, at the nondrive side, the guided portion 46*d* provided at the nondrive-side development bearing 46 guided by the first guide portion 93*a* of the apparatus main body A1 is received by the guide portion 81*a* having a bending shape of the nondrive-side swing guide 81 of the apparatus main body A1 by the attachment process. Accordingly, the development cartridge B1 is attached to the apparatus main body A1.

An operation of detaching the development cartridge B1 from the apparatus main body A1 is an operation reverse to the attachment operation.

Figure 9A:
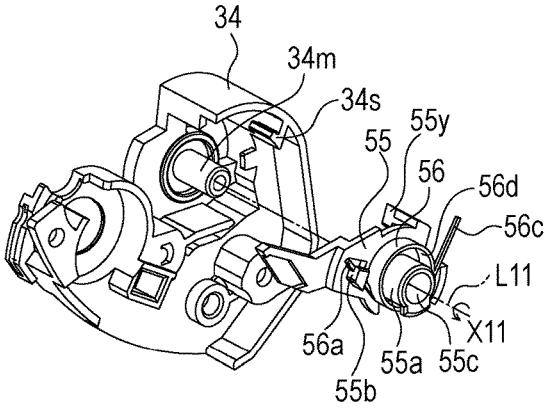
FIGS. 9A to 9D each illustrate a state of assembling a coupling lever and a coupling lever spring to a drive-side side cover according to the embodiment.
Figure 9B:
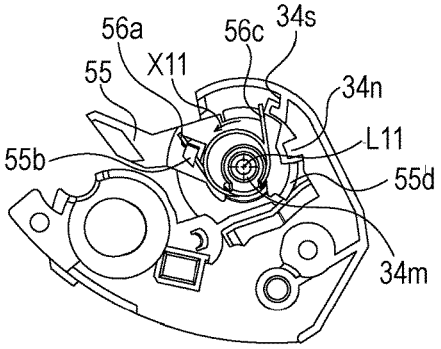
Figure 9C:
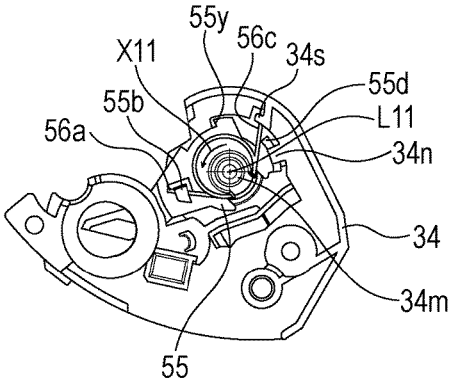
Figure 9D:
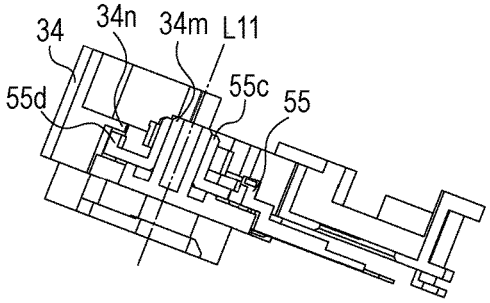

In this embodiment, a coupling lever 55 and a coupling lever spring 56 are provided at the development cartridge B1. A protrusion 34*m* of the drive-side side cover 34 is engaged with a recess 55*c* of the coupling lever 55, and is rotatable. A torsion coil spring is used for the coupling lever spring 56. One end of the coupling lever spring 56 is engaged with the coupling lever 55, and another end thereof is engaged with the drive-side side cover 34. To be specific, a coil-shaped wound portion 56*d* of the coupling lever spring 56 is engaged with a movement regulation portion 55*a*. An acting arm 56*a* of the coupling lever spring 56 is engaged with a spring hook portion 55*b* of the coupling lever 55. A fixed arm 56*c* of the coupling lever spring 56 is engaged with a spring hook portion 34*s* of the drive-side side cover 34 (see FIG. 9C). Consequently, the coupling lever 55 is urged to the coupling lever spring 56, a contact portion 55*d* of the coupling lever 55 contacts an angle regulation portion 34*n* provided at the drive-side side cover 34, and hence rotational movement is regulated.

In a state before the development cartridge B1 is attached to the apparatus main body A1, the coupling member 180 is urged by a coupling spring 185, and contacts the drive-side development bearing 36, the drive-side side cover 34, and the coupling lever 55. Accordingly, the coupling member 180 can be in a second inclined posture D2 directed toward the main-body-side driving member 100 of the apparatus main body A1. The coupling member 180 is attached to the apparatus main body A1 while keeping the second inclined posture D2. This second inclined posture D2 is a contact state where the photosensitive drum 10 is in contact with the developing roller 13.

There is a separate state where the development cartridge B1 is attached to the apparatus main body A1 and the photosensitive drum 10 is separated from the developing roller 13 from the contact state. In this case, when the contact state shifts to the separate state, a contact portion 80*y*

(FIG. 3) of the drive-side swing guide 80 contacts a rotation regulation portion 55*y* (FIGS. 6, 9A, and 9C) of the coupling lever 55. Accordingly, the coupling lever 55 is rotated against the urging force of the coupling lever spring 56. To be specific, by the movement of the drive-side swing guide 80, the coupling lever 55 is rotated in an arrow X11 direction around a rotational axis L11.

By the movement of the drive-side swing guide 80, the coupling lever 55 is rotated in the arrow X11 direction around the rotational axis L11. By the movement of the drive-side swing guide 80, the contact portion 80*y* contacts the rotation regulation portion 55*y*, and the coupling lever 55 is rotated against the urging force of the coupling lever spring 56. Consequently, since the coupling member 180 is urged by the coupling spring 185 to the retracted coupling lever 55, a rotational force receiving portion of the coupling member 180 may be in a first inclined posture D1 directed to the main-body-side driving member 100 of the apparatus main body A1.

In this embodiment, as described above, the rotational operation of the coupling lever 55 is associated with the drive-side swing guide 80 that moves in accordance with the development separate operation of the development cartridge B1, and the coupling member 180 may be in the first inclined posture D1 or the second inclined posture D2.

Attachment/detachment Configuration of Development Cartridge B1

A configuration in which the development cartridge B1 can be attached and detached by the drive-side swing guide 80 and the nondrive-side swing guide 81 of the apparatus main body A1 is described next. The configurations at the drive side and the configuration at the nondrive side are basically similar to one another, and hence the drive side of the development cartridge B1 is exemplarily described.

Figure 10A:
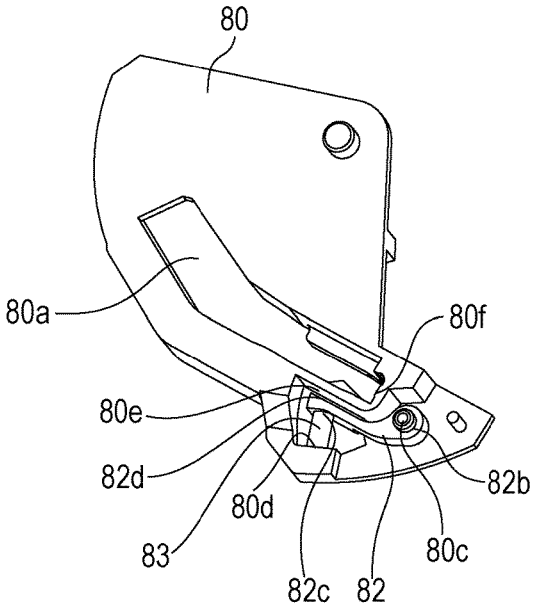
FIGS. 10A to 10E each are a perspective explanatory view showing a drive-side swing guide and drive-side pressing member according to the embodiment.
Figure 10B:
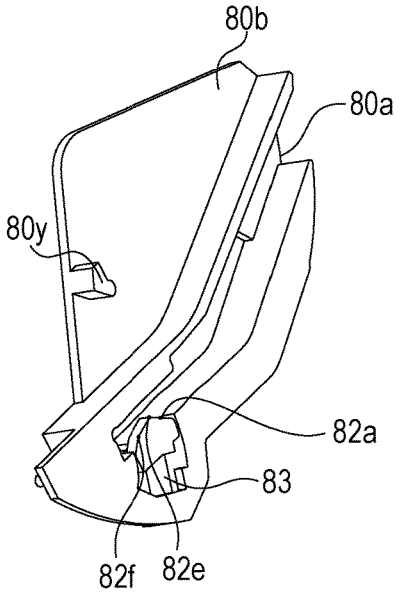
Figure 10C:
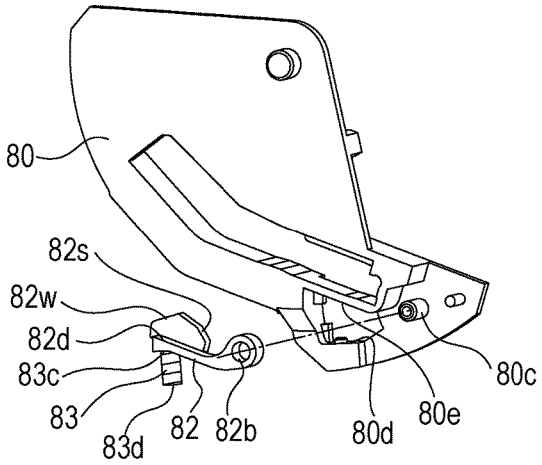
Figure 10D:
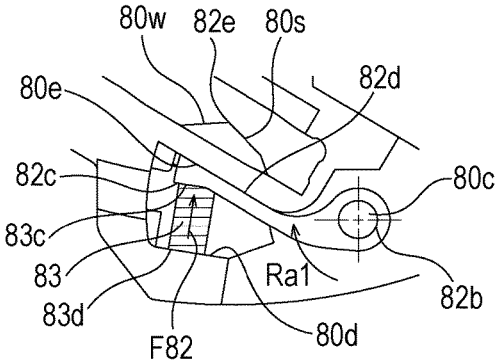
Figure 10E:
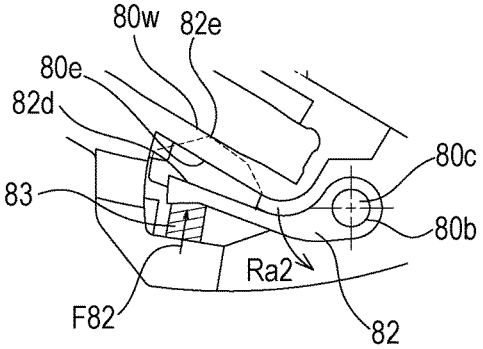

The drive-side swing guide 80 and a drive-side pressing member 82 are described first with reference to FIGS. 10A to 10E. FIG. 10A is a perspective view from the drive side in the longitudinal direction. FIG. 10B is a perspective view from the nondrive side in the longitudinal direction. FIG. 10C is an exploded perspective view of the drive-side swing guide 80, the drive-side pressing member 82, and a drive-side pressing spring 83. FIGS. 10D and 10E are enlarged specific views showing the periphery of the drive-side pressing member 82.

As shown in FIGS. 10A and 10B, the drive-side pressing member 82 has a positioning portion 82*a*, a hole 82*b*, a bearing surface 82*c*, and a regulation portion 82*d*. As shown in FIG. 10C, the drive-side swing guide 80 has a boss 80*c*. The hole 82*b* of the drive-side pressing member 82 is engaged with the boss 80*c*, and the drive-side pressing member 82 is supported rotatably around the boss 80*c*. Further, one end portion 83*c* of the drive-side pressing spring 83 being a compression spring is in contact with the bearing surface 82*c*. Also, as shown in FIG. 10D, another end portion 83*d* of the drive-side pressing spring 83 is in contact with a bearing surface 80*d* of the drive-side swing guide 80. Accordingly, the drive-side pressing member 82 receives an urging force F82 in a direction of rotating in an arrow Ra1 direction around the boss 80*c* of the drive-side swing guide 80. The regulation portion 82*d* of the drive-side pressing member 82 contacts a rotation regulation portion 80*e* provided at the drive-side swing guide 80. Hence, the rotation of the drive-side pressing member 82 in the arrow Ra1 direction is regulated and the position thereof is determined.

Meanwhile, as shown in FIG. 10E, the drive-side pressing member 82 is rotatable relative to the drive-side swing guide 80 in an arrow Ra2 direction against the urging force F82 of the drive-side pressing spring 83. The drive-side pressing member 82 is rotatable in the arrow Ra2 direction from a position at which the regulation portion 82*d* contacts the rotation regulation portion 80*e* of the drive-side swing guide 80 to a position at which an upper end portion 82*e* does not protrude from a guide surface 80*w* of the drive-side swing guide 80.

The state of the development cartridge B1 and the drive-side swing guide 80 in a process of attaching the development cartridge B1 to the apparatus main body A1 is described next with reference to FIGS. 11A to 11D. The development cartridge B1 is inserted into the apparatus main body A1 in the order as shown in FIGS. 11A, 11B, 11C, and 11D.

Figure 11A:
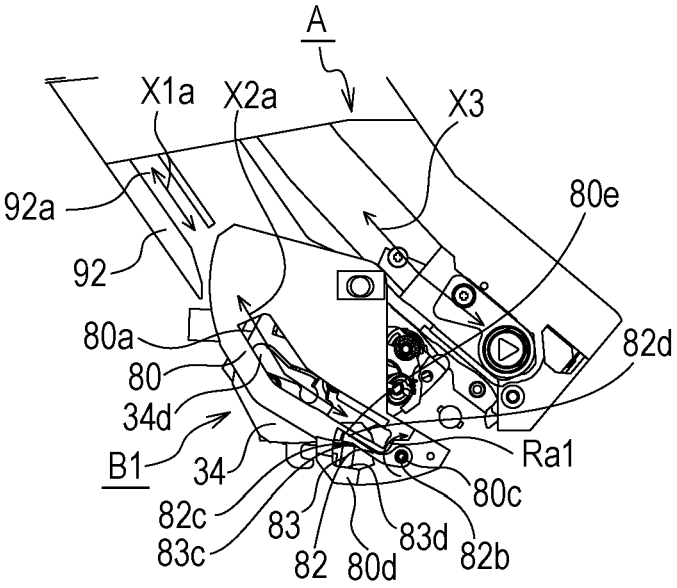
FIGS. 11A to 11D each are an explanatory view of the development cartridge when the development cartridge is separated in the apparatus main body according to the embodiment.

As shown in FIG. 11A, the guided portion 34*d* provided at the drive-side side cover 34 of the development cartridge B1 is inserted into the first guide portion 80*a* (FIG. 3) of the drive-side swing guide 80. Accordingly, the guided portion 34*d* is guided by the first guide portion 80*a* of the drive-side swing guide 80, and the development cartridge B1 is positioned on the attachment/detachment path X2*a*.

Figure 11B:
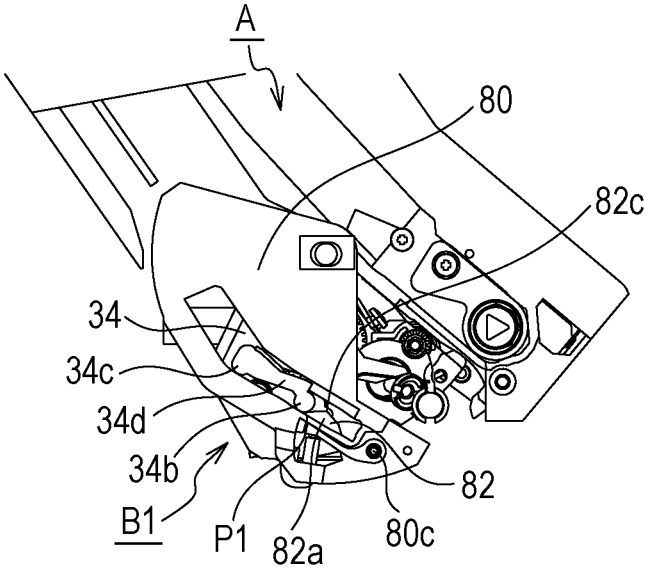

Then, as shown in FIG. 11B, the development cartridge B1 is further inserted from the state in FIG. 11A. Accordingly, the positioning portion 34*b* of the guided portion 34*d* contacts the positioning portion 82*a* of the drive-side pressing member 82 provided at the drive-side swing guide 80, at a point P1.

Figure 11C:
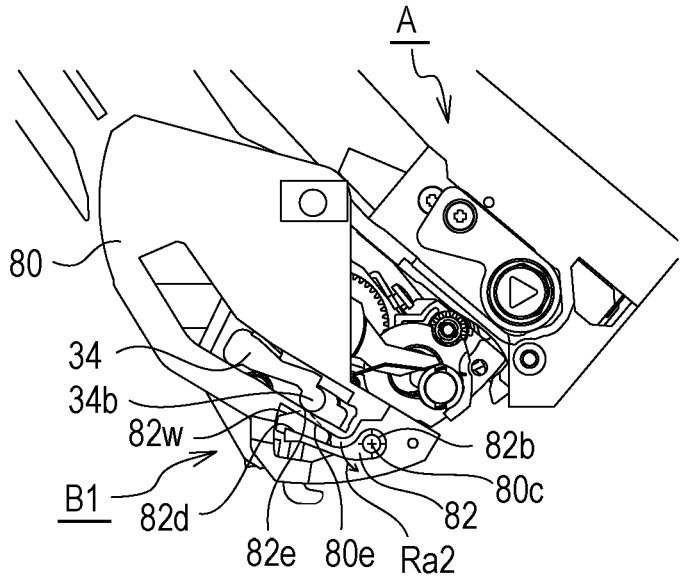

Next, as shown in FIG. 11C, the development cartridge B1 is further inserted from the state in FIG. 11B. Accordingly, the guided portion 34*d* of the drive-side side cover 34 in which the positioning portion 34*b* and the rotation stop portion 34*c* are integrated contacts a near-side inclined surface 82*w* of the drive-side pressing member 82, and pushes down the drive-side pressing member 82 in the arrow Ra2 direction. To be more specific, the guided portion 34*d* of the drive-side side cover 34 contacts the near-side inclined surface 82*w* of the drive-side pressing member 82, and presses the drive-side pressing member 82. Accordingly, the drive-side pressing member 82 is rotated counterclockwise (the arrow Ra2 direction) around the boss 80*c* of the drive-side swing guide 80 against the urging force F82 of the drive-side pressing spring 83. FIG. 11C shows a state where the positioning portion 34*b* of the drive-side side cover 34 is in contact with the upper end portion 82*e* of the drive-side pressing member 82. At this time, the regulation portion 82*d* of the drive-side pressing member 82 is separated from the rotation regulation portion 80*e* of the drive-side swing guide 80.

Figure 11D:
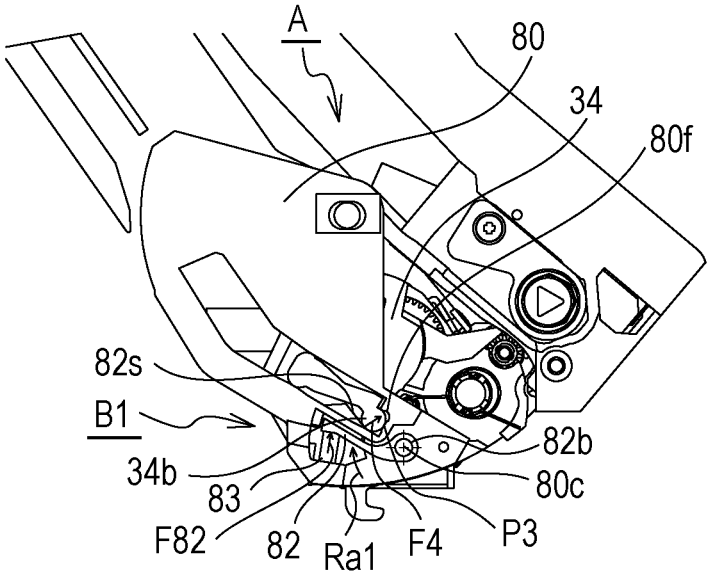

FIG. 11D shows a state where the development cartridge B1 is further inserted from the state in FIG. 11C, and the positioning portion 34*b* of the drive-side side cover 34 is in contact with a positioning portion 80*f* of the drive-side swing guide 80. As described above, the drive-side pressing member 82 receives the urging force F82 in the direction of rotating in the arrow Rat direction around the boss 80*c* of the drive-side swing guide 80. Accordingly, a deep-side inclined surface 82*s* of the drive-side pressing member 82 urges the positioning portion 34*b* of the drive-side side cover 34 with an urging force F4. Consequently, the positioning portion 34*b* contacts the positioning portion 80*f* of the drive-side swing guide 80 at a point P3 without a gap. Accordingly, the drive side of the development cartridge B1 is positioned and fixed with respect to the drive-side swing guide 80.

Positioning for the positioning portion 46*b* of the nondrive-side development bearing 46, and the nondrive-side swing guide 81 is similar to the drive side (the description is omitted). Accordingly, the development cartridge B1 is positioned and fixed with respect to the drive-side swing guide 80 and the nondrive-side swing guide 81.

Guide for Development Cartridge by Swing Guide

A guide configuration in the process of attaching the development cartridge B1 to the apparatus main body A1 is described next in detail. Description is given below for guide for the guided portion 34*d* of the drive-side side cover 34 by the drive-side swing guide 80, and guide for the guided portion 46*d* of the nondrive-side development bearing 46 by the nondrive-side swing guide 81.

Figure 12A:
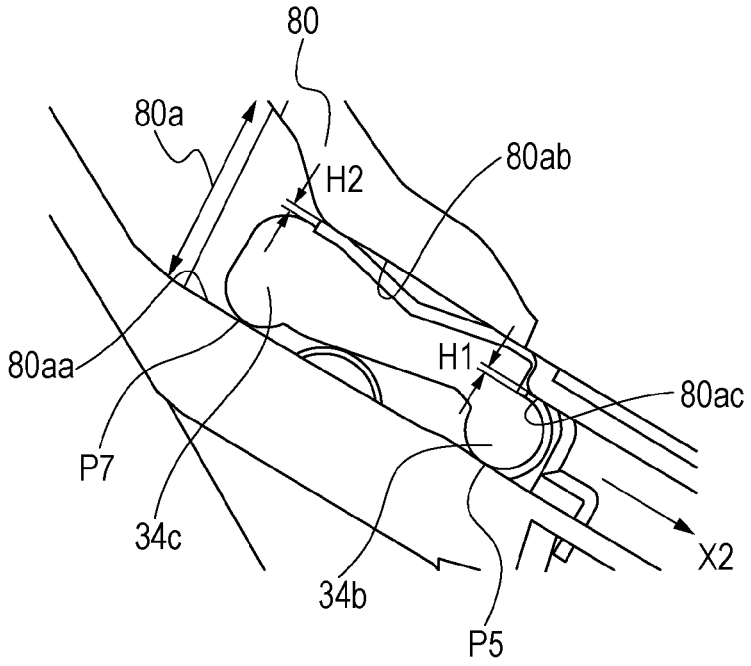
FIGS. 12A and 12B each are a side view of the drive-side side cover and the drive-side swing guide according to the embodiment.
Figure 12B:
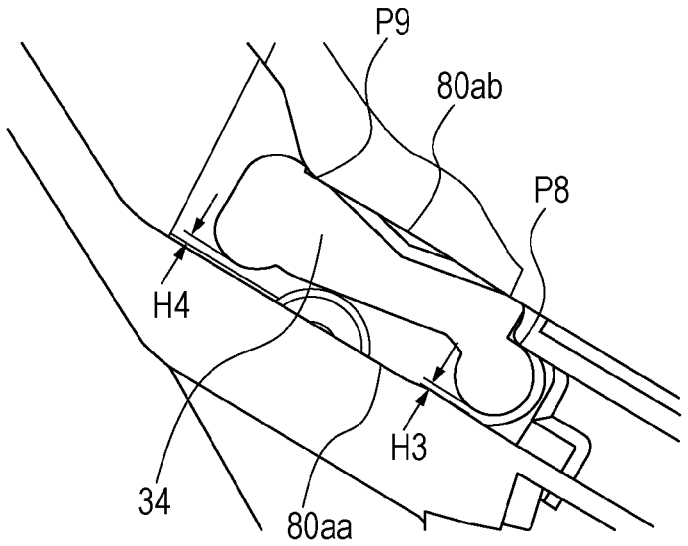

The guide for the guided portion 34*d* of the drive-side side cover 34 by the drive-side swing guide 80 is described first with reference to FIGS. 12A and 12B. FIGS. 12A and 12B each are a side view of the drive-side side cover 34 and the drive-side swing guide 80. FIG. 12A shows a state where the development cartridge B1 is attached along a guide lower surface 80*aa* of the first guide portion 80*a*. When the development cartridge B1 is attached to the apparatus main body A1, the positioning portion 34*b* and the rotation stop portion 34*c* of the drive-side side cover 34 contact the guide lower surface 80*aa* by the weight of the development cartridge B1. Accordingly, the development cartridge B1 is guided to move along the shape of the guide lower surface 80*aa*. To be specific, a point P5 of the positioning portion 34*b* and a point P7 of the rotation stop portion 34*c* of the drive-side side cover 34 come into contact with and are guided by the guide lower surface 80*aa* of the drive-side swing guide 80. In this way, the guided portion 34*d* shown in FIG. 11B is guided to a position at which the guided portion 34*d* contacts the drive-side pressing member 82 in the attachment/detachment path X2*a*. When the positioning portion 34*b* and the rotation stop portion 34*c* of the drive-side side cover 34 are guided by the guide lower surface 80*aa*, a gap H1 is provided between the positioning portion 34*b* and a guide upper surface 80*ac* of the drive-side swing guide 80. Similarly, when the positioning portion 34*b* and the rotation stop portion 34*c* are guided by the guide lower surface 80*aa*, a gap H2 is provided between the rotation stop portion 34*c* and a guide upper surface 80*ab*.

The guided portion 34*d* is urged upward by the drive-side pressing member 82. Accordingly, as shown in FIG. 12B, the guided portion 34*d* contacts the guide upper surface 80*ab* of the first guide portion 80*a*, and the development cartridge B1 is guided to move along the shape of the guide upper surface 80*ab*. At this time, a point P8 of the positioning portion 34*b* and a point P9 of the rotation stop portion 34*c* of the drive-side side cover 34 come into contact with and are guided by the guide upper surface 80*ab* of the drive-side swing guide 80. When the positioning portion 34*b* and the rotation stop portion 34*c* of the drive-side side cover 34 are guided by the guide upper surface 80*ab*, a gap H3 is provided between the positioning portion 34*b* and the guide lower surface 80*aa* of the drive-side swing guide 80. Similarly, when the positioning portion 34*b* and the rotation stop portion 34*c* are guided by the guide upper surface 80*ab*, a gap H4 is provided between the rotation stop portion 34*c* of the drive-side swing guide 80 and the guide upper surface 80*ab* of the drive-side swing guide.

Figure 1:
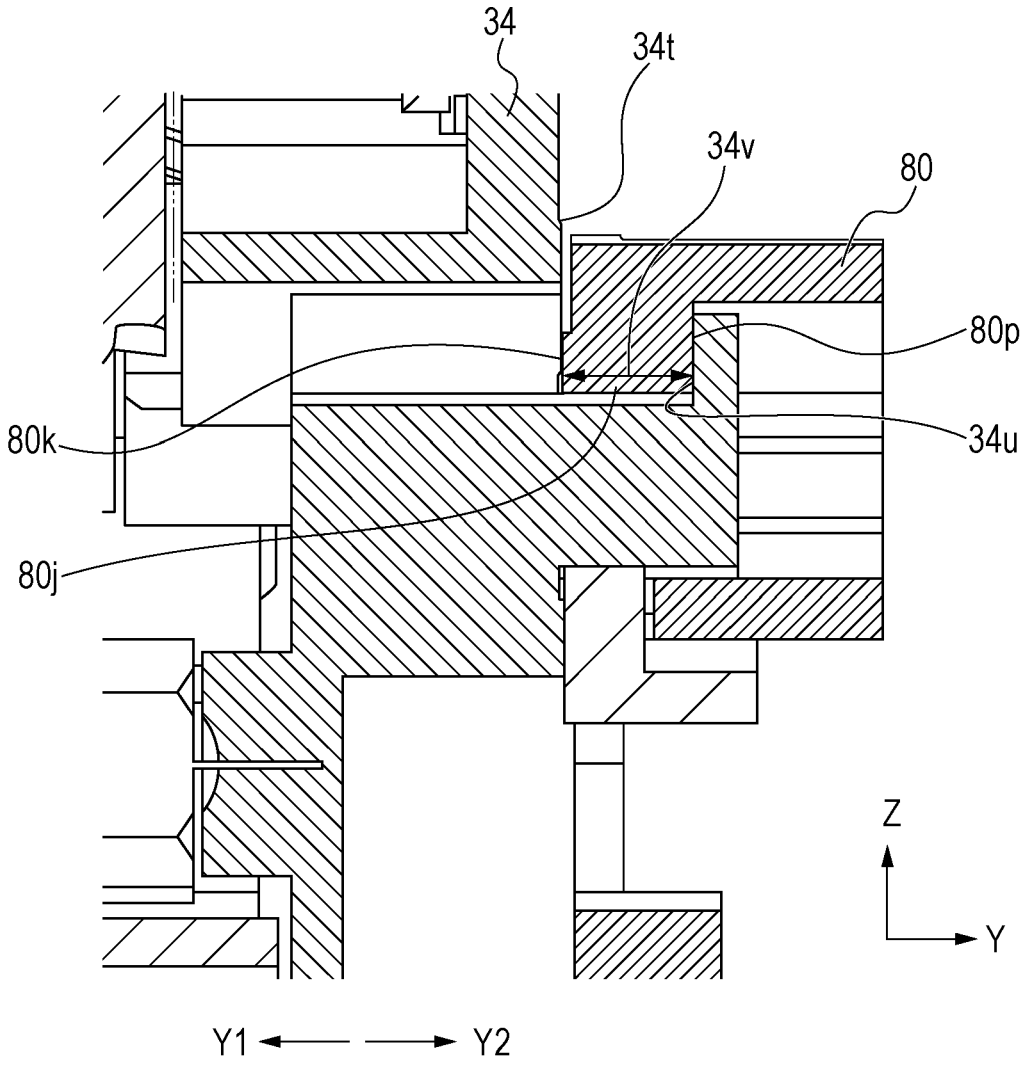
FIG. 1 is a cross-sectional view showing a positioning portion of a development cartridge according to an embodiment.
Figure 13:
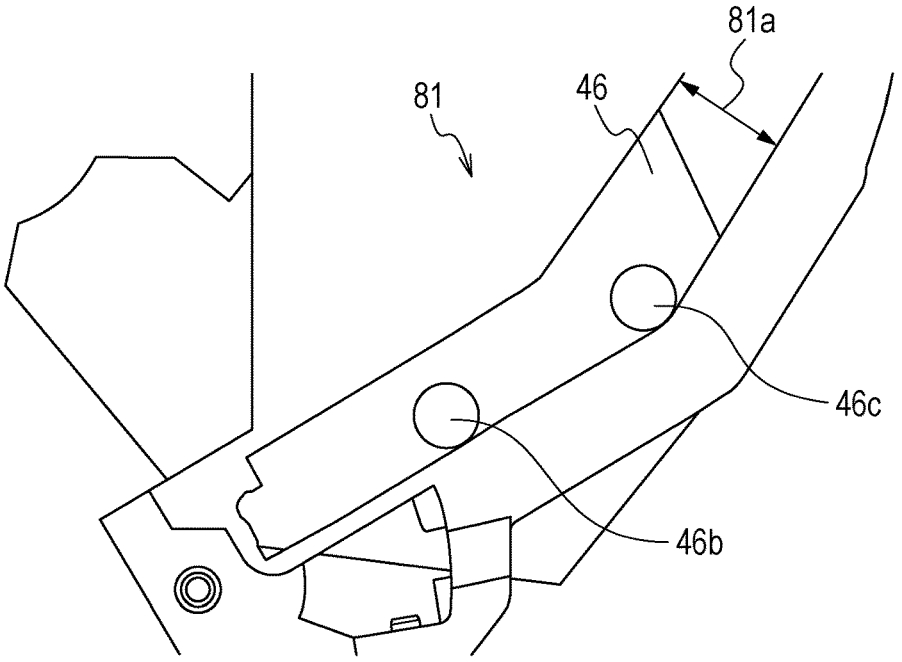
FIG. 13 is a side view of a nondrive-side development bearing and a nondrive-side swing guide according to the embodiment.
Figure 14:
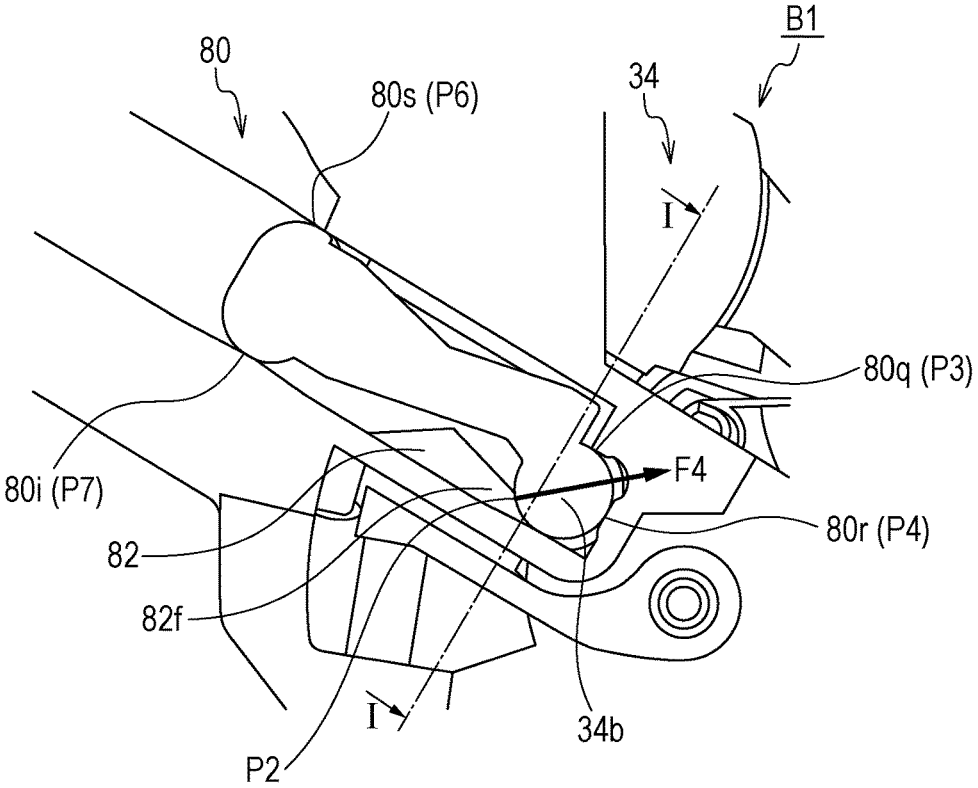
FIG. 14 is a side view of the development cartridge and the apparatus main body according to the embodiment.

Guide for the guided portion 46*d* of the nondrive-side development bearing 46 by the nondrive-side swing guide 81 is described next with reference to FIG. 13. FIG. 13 is a side view of the nondrive-side development bearing 46 and the nondrive-side swing guide 81 in view from the nondrive side in the process of attaching the development cartridge B1 to the apparatus main body A1. In the attachment/detachment path X2*a* in which the development cartridge B1 is attached to the apparatus main body A1, the positioning portion 46*b* and the rotation stop portion 46*c* of the nondrive-side development bearing 46 contact the first guide portion 81*a* by the weight of the development cartridge B1. Accordingly, the development cartridge B1 is guided to move along the shape of the first guide portion 81*a*. Positioning Configuration of Development Cartridge A method of positioning the development cartridge B1 with respect to the apparatus main body A1 in the longitudinal direction is described next in detail with reference to the drawing. FIG. 14 is a side view of a state where the development cartridge B1 is attached to the apparatus main body A1 and the attachment is completed. Also, FIG. 1 is a cross-sectional view taken along line I-I in FIG. 14. The drive-side side cover 34 has a longitudinal positioning portion 34*v* configured to face a first longitudinal positioning surface 34*t* at one side (center side) and a second longitudinal positioning surface 34*u* at another side (outer side) in the longitudinal direction. In this configuration, the longitudinal positioning portion 34*v* has a recessed shape (groove) extending in a direction intersecting with the longitudinal direction. Also, the drive-side swing guide 80 has a longitudinal positioned portion 80*j*. A first longitudinal positioned surface 80*k* at the one side (center side) and a second longitudinal positioned surface 80*p* at the other side (outer side) are provided at both sides of the longitudinal positioned portion 80*j*. With this configuration, the longitudinal positioned portion 80*j* has a protruding shape extending in a direction intersecting with the longitudinal direction. The drive-side side cover 34 and the drive-side swing guide 80 are configured such that the longitudinal positioning portion 34*v* is engaged with the longitudinal positioned portion 80*j*.

As shown in FIG. 14, the positioning portion 34*b* of the drive-side side cover 34 contacts a positioned portion 82*f* of the drive-side pressing member 82 at a point P2. Accordingly, the positioning portion 34*b* receives the urging force F4 from the drive-side pressing member 82. Consequently, the positioning portion 34*b* contacts a positioning surface 80*q* of the drive-side swing guide 80 located at the upper side of the positioning portion 34*b* at a point P3, and contacts a positioning surface 80*r* of the drive-side swing guide 80 located at the downstream side in the attachment direction at a point P4. The rotation stop portion 34*c* of the drive-side side cover 34 contacts a rotation stop surface 80*s* of the drive-side swing guide 80 at a point P6, and contacts a rotation stop surface 80*i* of the drive-side swing guide 80 at a point P7. As described above, the positioning portion 34*b* of the guided portion 34*d* is positioned at the three points of the points P2, P3, and P4, and the rotation stop portion 34*c* of the guided portion 34*d* is positioned at one of the points P6 and P7. Hence, the guided portion 34*d* is positioned in the direction orthogonal to the longitudinal direction.

Also, as shown in FIG. 1, the first longitudinal positioning surface 34*t* of the drive-side side cover 34 contacts the first longitudinal positioned surface 80*k* of the drive-side swing guide 80. Accordingly, the movement of the drive-side side cover 34 to the one side (center side) in the longitudinal direction is regulated. Similarly, the second longitudinal positioning surface 34*u* of the drive-side side cover 34 contacts the second longitudinal positioned surface 80*p* of the drive-side swing guide 80. Hence, the movement of the drive-side side cover 34 to the other side (outer side) in the longitudinal direction is regulated. In this way, the drive-side side cover 34 and the drive-side swing guide 80 are relatively positioned in the longitudinal direction.

Figure 15:
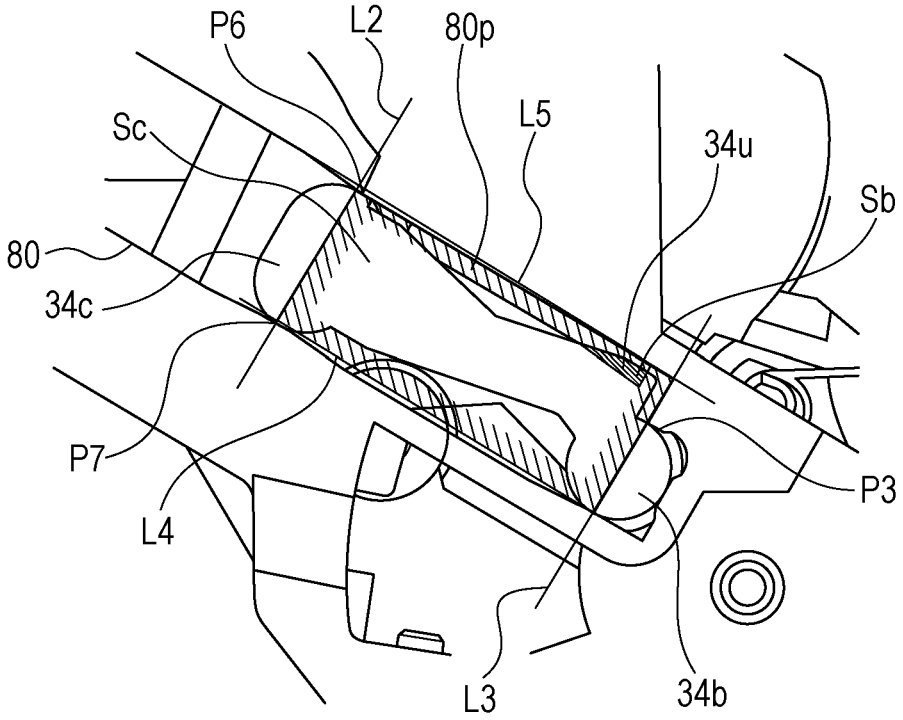
FIG. 15 is a side view showing the development cartridge and the drive-side swing guide according to the embodiment.

Arrangement of the positioning configuration at the drive side is described below in detail. FIG. 15 is a side view showing the development cartridge B1 and the drive-side swing guide 80. It is assumed that a line extending at the point P6 or P7, at which the rotation stop portion 34*c* of the drive-side side cover 34 contacts the drive-side swing guide 80, in the width direction of the first guide portion 80*a* (vertical line or normal line direction) serves as a line L2. Also, a line extending at the point P3 of the positioning portion 34*b* of the drive-side side cover 34 in the width direction of the first guide portion 80*a* (vertical line or normal line direction) serves as a line L3. A line connecting the point P7 of the rotation stop portion 34*c* of the drive-side side cover 34 with the point P5 of the positioning portion 34*b* of the drive-side side cover 34 serves as a line L4. The line L4 is parallel to the attachment/detachment direction X2*a*. Also, if the rotation stop portion 34*c* contacts the drive-side swing guide 80 at the point P7, a line parallel to the line L3 passing through a point with a larger width of the first guide portion 80*a* among the points P7 and P3 serves as a line L5. In contrast, if the rotation stop portion 34*c* contacts the drive-side swing guide 80 at the point P6, a line parallel to the line L3 passing through a point with a larger width of the first guide portion 80*a* among the points P6 and P3 serves as the line L5. Then, a range used for cross-sectional positioning surrounded by the four lines of the lines L2, L3, L4, and L5 serves as a cross-sectional positioning range Sc. In other words, the cross-sectional positioning range Sc has a width having one end at the point P6 or P7, at which the rotation stop portion 34*c* contacts the drive-side swing guide 80, and another end at the point P3 in the attachment direction of the cartridge. Also, the cross-sectional positioning range Sc has a height which is a width of the first guide portion 80*a* at the point P3 or P5 above the guide lower surface 80*aa*. The rectangular region determined by such width and height serves as the cross-sectional positioning range Sc.

Also, a range where the second longitudinal positioning surface 34*u* of the longitudinal positioning portion 34*v* contacts the second longitudinal positioned surface 80*p* of the longitudinal positioned portion 80*j* and hence contacts the drive-side swing guide 80 for positioning in the longitudinal direction serves as a longitudinal positioning range Sb. To be specific, in this embodiment, the longitudinal positioning portion 34*v* is formed at the coupling portion that couples the positioning portion 34*b* and the rotation stop portion 34*c*.

In this embodiment, as shown in FIG. 15, the longitudinal positioning range Sb and the cross-sectional positioning range Sc are arranged to be located in an overlapping manner in the longitudinal direction. In FIG. 15, the longitudinal positioning range Sb overlaps the entire region of the cross-sectional positioning range Sc. However, the longitudinal positioning range Sb may overlap at least a portion of the cross-sectional positioning range Sc in the longitudinal direction. That is, in this configuration, the cross-sectional positioning range Sc may overlap the longitudinal positioning range Sb in the cross-sectional direction.

Longitudinal Positioning of Development Cartridge

The positioning direction in the longitudinal direction of the development cartridge B1 in the process of attaching the development cartridge B1 to the apparatus main body A1 is described below with reference to the drawing. In the process of attaching the development cartridge B1 to the apparatus main body A1, the first longitudinal positioning surface 34*t* of the drive-side side cover 34 is brought into contact with the first longitudinal positioned surface 80*k* of the drive-side swing guide 80 first, and hence the movement to the one side in the longitudinal direction is regulated. Then, the second longitudinal positioning surface 34*u* of the drive-side side cover 34 is brought into contact with the second longitudinal positioned surface 80*p* of the drive-side swing guide 80, and hence the movement to the other side in the longitudinal direction is regulated.

Regulation of First Longitudinal Positioning Surface of Drive-Side Side Cover

A configuration in which the first longitudinal positioning surface 34*t* of the drive-side side cover 34 regulates the movement in the longitudinal direction at the first longitudinal positioned surface 80*k* of the drive-side swing guide 80 is described next with reference to the drawings.

Figure 16B:
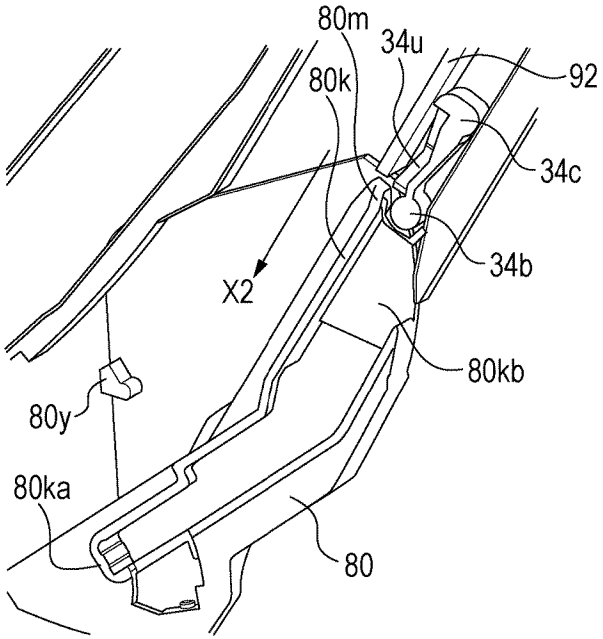
FIGS. 16A to 16C each are a side view of the development cartridge and the apparatus main body according to the embodiment.
Figure 16A:
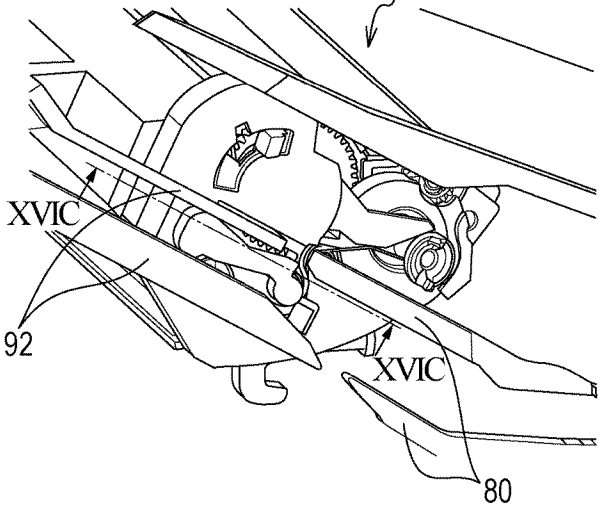
Figure 16C:
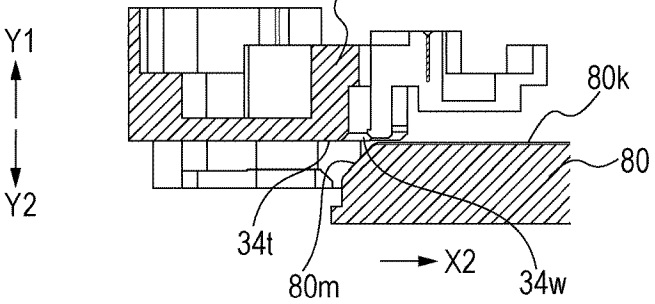

FIGS. 16A to 16C each illustrate a state of the process of attaching the development cartridge B1 to the apparatus main body A1. FIGS. 16A to 16C each illustrate a state immediately before the development cartridge B1 is received by the drive-side swing guide 80 from the drive-side guide member 92.

FIG. 16A is a perspective view of the development cartridge B1, the drive-side swing guide 80 (partly cross-sectional view), and the drive-side guide member 92 (partly cross-sectional view) from the drive side. FIG. 16C is a cross-sectional view taken along line XVIC-XVIC in FIG. 16A. FIG. 16B is a perspective view of the drive-side side cover 34 (only the positioning portion 34*b*, the rotation stop portion 34*c*, and the second longitudinal positioning surface 34*u* are illustrated), the drive-side swing guide 80, and the drive-side guide member 92 (partly cross-sectional view) from the nondrive side.

As shown in FIGS. 16A and 16C, a first leading shape 34*w* is provided at the downstream side in an attachment direction X2 of the first longitudinal positioning surface 34*t* of the drive-side side cover 34. In contrast, a positioning completion portion 80*ka* and a passing portion 80*kb* connected with the positioning completion portion 80*ka* are provided at the first longitudinal positioned surface 80*k* of the drive-side swing guide 80 along the attachment direction X2 of the development cartridge B1. Also, a first led shape 80*m* is provided at the upstream side in the attachment direction X2 of the first longitudinal positioned surface 80*k*. As the development cartridge B1 is attached to the apparatus main body A1 in the attachment direction X2, the first leading shape 34*w* of the drive-side side cover 34 can contact the first led shape 80*m* of the drive-side swing guide 80. Accordingly, the development cartridge B1 can be smoothly attached to the apparatus main body A1 without interference, while the drive-side swing guide 80 is not hooked to the drive-side side cover 34 and relative movement to one direction in the longitudinal direction is regulated.

As the development cartridge B1 is attached to the apparatus main body A1, the first longitudinal positioning surface 34*t* of the drive-side side cover 34 contacts the first longitudinal positioned surface 80*k* of the drive-side swing guide 80. Accordingly, the movement of the drive-side side cover 34 is regulated relative to the drive-side swing guide 80 to the Y2 side (outer side in FIG. 1) in the longitudinal direction. That is, the position of the development cartridge B1 to the Y2 side in the longitudinal direction is regulated. At this time, the movement of the drive-side side cover 34 to the Y1 side (center side in FIG. 1) in the longitudinal direction is not regulated yet.

Regulation of Second Longitudinal Positioning Surface of Drive-Side Side Cover

Figure 17B:
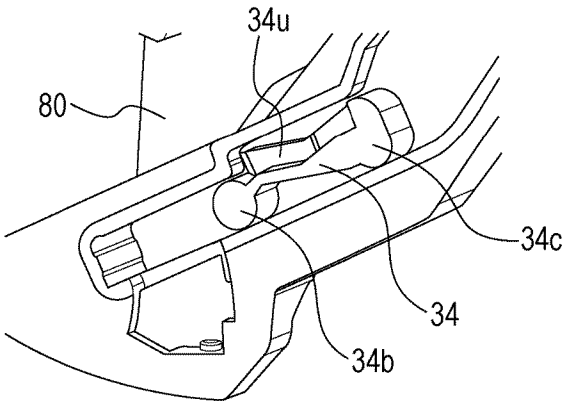
FIGS. 17A to 17C are perspective views and a cross-sectional view according to the embodiment when the drive-side side cover and the drive-side swing guide are viewed from the drive side.
Figure 17A:
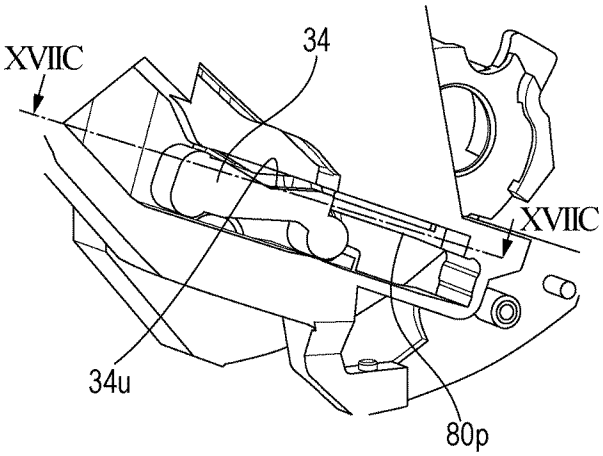
Figure 17C:
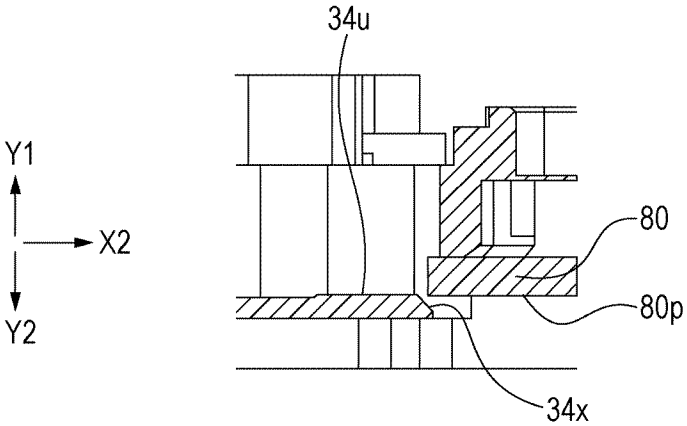

A configuration in which the second longitudinal positioning surface 34*u* of the drive-side side cover 34 regulates the movement in the longitudinal direction at the second longitudinal positioned surface 80*p* of the drive-side swing guide 80 is described next with reference to the drawings. FIGS. 17A to 17C each illustrate a state where the development cartridge B1 is further inserted to the downstream side from the attachment state of the development cartridge B1 to the apparatus main body A1 shown in FIGS. 16A to 16C. FIGS. 17A to 17C each illustrate a state immediately before the second longitudinal positioning surface 34*u* of the drive-side side cover 34 is engaged with the second longitudinal positioned surface 80*p* of the drive-side swing guide 80. FIG. 17A is a perspective view of the drive-side side cover 34 and the drive-side swing guide 80 from the drive side. FIG. 17C is a cross-sectional view taken along line XVIIC-XVIIC in FIG. 17A. FIG. 17B is a perspective view of the drive-side side cover 34 (only the positioning portion 34*b*, the rotation stop portion 34*c*, and the second longitudinal positioning surface 34*u* are illustrated), and the drive-side swing guide 80 from the nondrive side.

As shown in FIG. 17C, a second leading shape 34*x* is provided at the downstream side in the attachment direction X2 of the second longitudinal positioning surface 34*u* of the drive-side side cover 34. As the development cartridge B1 is attached in the attachment direction X2, the second leading shape 34*x* can contact the second longitudinal positioned surface 80*p*. Accordingly, the development cartridge B1 can be smoothly attached to the apparatus main body A1 without interference, while the drive-side swing guide 80 is not hooked to the drive-side side cover 34 and relative movement to the one direction in the longitudinal direction is regulated.

As the development cartridge B1 is attached to the apparatus main body A1, the second longitudinal positioning surface 34*u* of the drive-side side cover 34 contacts the second longitudinal positioned surface 80*p* of the drive-side swing guide 80. Accordingly, the movement of the drive-side side cover 34 is regulated relative to the drive-side swing guide 80 to the Y1 side (outer side in FIG. 1) in the longitudinal direction. That is, the position of the development cartridge B1 to the Y1 side in the longitudinal direction is regulated.

As described above, when the development cartridge B1 is attached to the apparatus main body A1, the longitudinal positioning portion 34*v* of the drive-side side cover 34 is engaged with the longitudinal positioned portion 80*j* of the drive-side swing guide 80. The engagement position between the longitudinal positioning portion 34*v* and the longitudinal positioned portion 80*j* is located at the upstream side in the attachment/detachment direction X2*a* with respect to the position at which the engagement between the coupling member 180 and the main-body-side driving member 100 is started. That is, when the engagement between the main-body-side driving member 100 and the coupling member 180 is started, the position of the development cartridge B1 to the Y1 side in the longitudinal direction is regulated. In other words, when the engagement between the main-body-side driving member 100 and the coupling member 180 is started, the longitudinal positions of the coupling member 180 and the main-body-side driving member 100 are regulated at predetermined positions. Hence, the coupling member 180 and the main-body-side driving member 100 can be stably engaged with each other.

(7) Advantageous Effects

Figure 18:
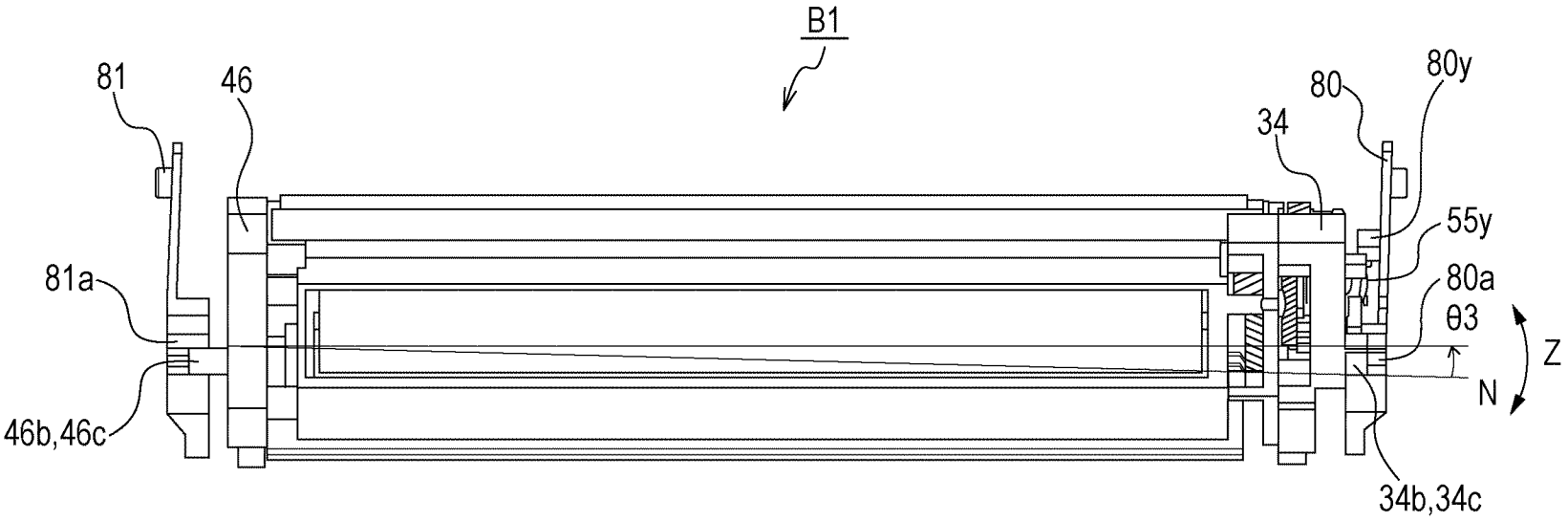
FIG. 18 is a front view viewed from the front of the development cartridge, the drive-side swing guide, and the nondrive-side swing guide according to the embodiment.

FIG. 18 is a front view showing the development cartridge B1, the drive-side swing guide 80, and the nondrive-side swing guide 81, from the front in the process of attaching the development cartridge B1 to the apparatus main body A1. The cartridge may be occasionally inserted in a manner that the longitudinal direction of the cartridge is inclined with respect to a cartridge longitudinal direction N located at the attachment position of the apparatus main body A1 before the longitudinal positioning portion 34*v* of the drive-side side cover 34 is engaged with the longitudinal positioned portion 80*j* of the drive-side swing guide 80. To be specific, as shown in FIG. 18, the development cartridge may not be inserted in parallel, but may be inserted in an inclined manner by an angle θ3 with respect to the cartridge longitudinal direction N at the attachment position.

Even in this case, since the longitudinal positioning range Sb overlaps the cross-sectional positioning range Sc in this embodiment, the development cartridge B1 can be further reliably attached to the apparatus main body A1. In other words, when the development cartridge B1 is attached to the apparatus main body A1, the development cartridge B1 is prevented from being hooked in the apparatus main body A1, and usability can be increased. To be specific, when the development cartridge B1 is attached to the apparatus main body A1, the positioning portion 34*b* and the rotation stop portion 34*c* of the drive-side side cover 34 contact the guide lower surface 80*aa* by the weight of the development cartridge B1. Consequently, the point P5 of the positioning portion 34*b* and the point P7 of the rotation stop portion 34*c* of the drive-side side cover 34 contact the guide lower surface 80*aa* of the drive-side swing guide 80, and hence serve as the rotation center in a Z direction. Owing to this, in this embodiment, at least a portion of the longitudinal positioning range Sb overlaps the cross-sectional positioning range Sc in the longitudinal direction, and arranged close to the points P5 and P7. Accordingly, the longitudinal positioning range Sb is located at the position close to the rotational center, and the development cartridge B1 can be smoothly attached to the apparatus main body A1 while the drive-side side cover 34 is not hooked to the drive-side swing guide 80.

By providing the first leading shape 34*w* at the guided portion 34*d* and providing the first led shape 80*m* at the drive-side swing guide 80 like this embodiment, the drive-side side cover 34 can be further reliably prevented from being hooked to the drive-side swing guide 80.

Also, since at least a portion of the longitudinal positioning range Sb overlaps the cross-sectional positioning range Sc in the longitudinal direction, the size of the guided portion 34*d* of the drive-side side cover 34 can be decreased, and hence the development cartridge B1 can be decreased in size. Consequently the size of the apparatus main body A1, to which the development cartridge B1 is attached, can be decreased.

In the above-described embodiment, the configuration has been described in which the photosensitive drum and the developing roller are formed in the individual cartridges and the present invention is applied to the development cartridge. However, without limiting to this configuration, the photosensitive drum serving as the image carrying member and the process unit acting on the photosensitive drum may be integrally formed in a process cartridge, and the process cartridge may be used as the aforementioned cartridge. Various modifications can be made within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-183148 filed Sep. 16, 2015, which is hereby incorporated by reference herein in its entirety.

What is claimed is:

1. A cartridge attachable to and detachable from an image forming apparatus, comprising:

a rotatable developer carrying member; and a development container configured to support the developer carrying member, wherein the development container includes a positioning portion and a rotation stop portion provided at one end in an axial direction of the developer carrying member and configured to be engaged with and guided by a guide of the image forming apparatus, and also includes a longitudinal positioning portion provided at the one end in the axial direction of the developer carrying member and configured to contact the guide and position the development container in a longitudinal direction, and wherein, in a state where the cartridge is attached to the image forming apparatus, when a cross-sectional positioning range is defined by using a width, having one end at a point at which the rotation stop portion contacts the guide and another end at a point at which the positioning portion contacts the guide in an attachment direction of the cartridge, and a height being a width of the guide at the point at which the rotation stop portion contacts the guide or the point at which the positioning portion contacts the guide, the longitudinal positioning portion overlaps the cross-sectional positioning range in the longitudinal direction.

2. The cartridge according to claim 1, wherein the positioning portion and the rotation stop portion are arranged in that order from a downstream side in the attachment direction of the cartridge with respect to the image forming apparatus.

3. The cartridge according to claim 1, wherein the positioning portion and the rotation stop portion are connected with a coupling portion, and the longitudinal positioning portion is provided at the coupling portion.

4. A member used for a cartridge attachable to and detachable from an image forming apparatus, wherein the cartridge includes a rotatable developer carrying member, and a development container configured to support the developer carrying member, wherein the member includes a positioning portion and a rotation stop portion provided at one end of the development container in an axial direction of the developer carrying member and configured to be engaged with and guided by a guide of the image forming apparatus, and also includes a longitudinal positioning portion provided at the one end in the axial direction of the developer carrying member and configured to contact the guide and position the member in a longitudinal direction, and wherein, in a state where the cartridge is attached to the image forming apparatus, when a cross-sectional positioning range is defined by using a width, having one end at a point at which the rotation stop portion contacts the guide and another end at a point at which the positioning portion contacts the guide in an attachment direction of the cartridge, and a height being a width of the guide at the point at which the rotation stop portion contacts the guide or the point at which the positioning portion contacts the guide, the longitudinal positioning portion overlaps the cross-sectional positioning range in the longitudinal direction.

5. The member according to claim 4, wherein the positioning portion and the rotation stop portion are arranged in that order from a downstream side in the attachment direction of the cartridge with respect to the image forming apparatus.

6. The member according to claim 4, wherein the positioning portion and the rotation stop portion are connected with a coupling portion, and the longitudinal positioning portion is provided at the coupling portion.

* * * * *